US006186498B1

(12) United States Patent
Suzuki et al.

(10) Patent No.: US 6,186,498 B1
(45) Date of Patent: Feb. 13, 2001

(54) SHEET REGISTRATION APPARATUS

(75) Inventors: Kaoru Suzuki, Yamatokoriyama; Junya Masuda, Kashihara; Toshihisa Matsuo, Nara; Koji Katamoto, Yamatokoriyama, all of (JP)

(73) Assignee: Sharp Kabushiki Kaisha, Osaka (JP)

( * ) Notice: Under 35 U.S.C. 154(b), the term of this patent shall be extended for 0 days.

(21) Appl. No.: 09/153,292

(22) Filed: Sep. 15, 1998

(30) Foreign Application Priority Data

Sep. 16, 1997 (JP) ..... 9-250184

(51) Int. Cl.[7] ..... B65H 9/16; B65H 31/36; B65H 33/04

(52) U.S. Cl. ..... 271/250; 270/58.12; 271/221

(58) Field of Search ..... 271/250; 270/58.12, 270/58.16, 58.17, 58.27

(56) References Cited

U.S. PATENT DOCUMENTS

| | | | | |
|---|---|---|---|---|
| 4,248,413 | * | 2/1981 | Fox | 270/58.17 |
| 4,930,761 | | 6/1990 | Naito et al. . | |
| 5,048,817 | | 9/1991 | Roller . | |
| 5,215,302 | * | 6/1993 | Bedzyk | 271/239 |
| 5,345,303 | | 9/1994 | Hiroi et al. . | |
| 5,382,016 | | 1/1995 | Kobayashi et al. . | |
| 5,562,399 | * | 10/1996 | Schulz | 414/795 |
| 5,634,632 | * | 6/1997 | Furuya et al. | 270/58.12 |
| 5,713,566 | * | 2/1998 | Coombs et al. | 270/58.12 |
| 5,857,670 | * | 1/1999 | Jung | 270/58.12 |

FOREIGN PATENT DOCUMENTS

| | | |
|---|---|---|
| 13917028 | 11/1989 | (DE) . |
| 3-138255 | 6/1991 | (JP) . |
| B2-7-25469 | 3/1995 | (JP) . |

OTHER PUBLICATIONS

Japanese Patent Publication No. 59 177251 (A); published Oct. 6, 1984—Abstract only.

Japanese Patent Publication No. 08 310711 (A); published Nov. 26, 1996—Abstract only.

Japanese Patent Publication No. 61 140459 (A); published Jun. 27, 1986—Abstract only.

Japanese Patent Publication No. 02 193861 (A); published Jul. 31, 1990—Abstract only.

* cited by examiner

*Primary Examiner*—Donald P. Walsh
*Assistant Examiner*—Brett C. Martin

(57) ABSTRACT

A sheet registration apparatus for registering sheets all at one time by regulating them at a reference position on the side of the sheet transport direction and on the side perpendicular to the sheet transport side. The sheet registration apparatus comprises: a regulation plate for regulating the side of the sheets perpendicular to the discharge direction (or transport direction) thereof with respect to sort bins for receiving the sheets which have been imaged by an image forming apparatus; and a reference wall for regulating the side of the sheets in the transport direction. On the other hand, a registration rod, as extended through inclined openings formed in the sort bins, are moved toward the regulation plate and turned to the direction to feed the sheets toward the reference wall, so that the sheets are registered while being regulated by the regulation plate and the reference wall in accordance with the movement for the registration of the registration rod.

15 Claims, 30 Drawing Sheets

| FIG. 15A |
| --- |
| FIG. 15B |

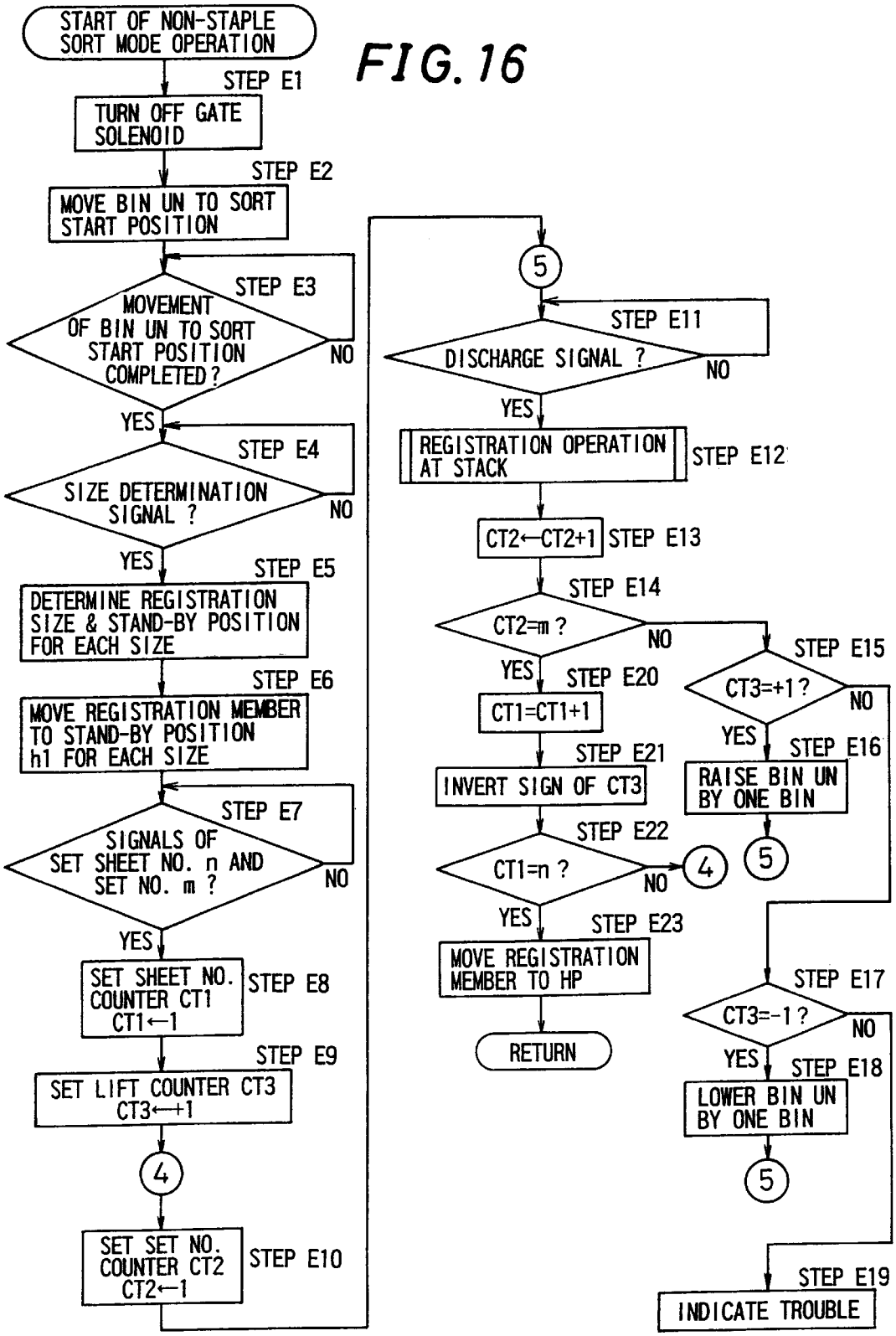
FIG. 16
START OF NON-STAPLE SORT MODE OPERATION
STEP E1
TURN OFF GATE SOLENOID
STEP E2
MOVE BIN UN TO SORT START POSITION
STEP E3
MOVEMENT OF BIN UN TO SORT START POSITION COMPLETED ?
NO
YES
STEP E4
SIZE DETERMINATION SIGNAL ?
NO
YES
STEP E5
DETERMINE REGISTRATION SIZE & STAND-BY POSITION FOR EACH SIZE
STEP E6
MOVE REGISTRATION MEMBER TO STAND-BY POSITION h1 FOR EACH SIZE
STEP E7
SIGNALS OF SET SHEET NO. n AND SET NO. m ?
NO
YES
SET SHEET NO. COUNTER CT1 CT1←1
STEP E8
STEP E9
SET LIFT COUNTER CT3 CT3←+1
4
SET SET NO. COUNTER CT2 CT2←1
STEP E10
5
STEP E11
DISCHARGE SIGNAL ?
NO
YES
REGISTRATION OPERATION AT STACK
STEP E12
CT2←CT2+1
STEP E13
STEP E14
CT2=m ?
NO
YES
STEP E20
CT1=CT1+1
STEP E21
INVERT SIGN OF CT3
STEP E22
CT1=n ?
NO
4
YES
STEP E23
MOVE REGISTRATION MEMBER TO HP
RETURN
STEP E15
CT3=+1 ?
NO
YES
STEP E16
RAISE BIN UN BY ONE BIN
5
STEP E17
CT3=-1 ?
NO
YES
STEP E18
LOWER BIN UN BY ONE BIN
5
STEP E19
INDICATE TROUBLE

SHEET REGISTRATION APPARATUS

BACKGROUND OF THE INVENTION

1. Field of the Invention

The present invention relates to a sheet registration apparatus in an image forming apparatus such as a copying machine, a printer or an ordinary paper facsimile, for stacking a plurality of imaged sheets and registering the stacked sheets.

2. Description of the Related Art

In copying machines, printers, ordinary paper facsimile apparatuses or the like, desired images are formed on the sheets, and the imaged sheets are discharged to the outside of the apparatus. Some of such apparatuses are equipped with an apparatus for post-treating or stapling a plurality of imaged sheets into a bundle.

Such image forming apparatus equipped with the sheet post-treating apparatus is disclosed in Japanese Examined Patent Publication JP-B2 7-25469 (1995), for example. FIG. 38 is a perspective view showing the sheet post-treating apparatus 200 such as a sorter, which is arranged to have its receiving mouth at such a portion of the image forming apparatus as to discharge the imaged sheets. The sorter 200 is equipped with a number of sort bins 201 which are provided for sorting the sheets discharged.

In the sorter 200, the numerous sorting sort bins 201 are arranged in a vertically stacked state for stacking the discharged sheets sequentially on their upper faces. The individual sort bins 201 are arranged so as to vertically move to the position corresponding to the sorting exit of the image forming apparatus, for example, to receive the sheets, as discharged from the exit. The sort bins 201 are guided at their leading end portions in the sheet discharge direction, when moved up and down, by a support member for uniting the sort bins and are connected at their opposite end portions on the side of the exit to a lift mechanism 203 so that the sort bins 201 are moved up and down according to the turning direction of the lift mechanism 203.

When the sheets to be sorted are discharged, the sort bins 201 are ascended or descended by the lift mechanism 203 thereby to position each sort bin 201 at the sorting exit, and the sheets are discharged to the sort bins 201, as sequentially assigned. In order that the one-side end edges, as perpendicular to the discharge direction, of the sheets discharged to the individual sort bins 201, may be registered to a regulation member 204, the sorter 200 is equipped with a registration apparatus 205 having a registration rod 206 which is made movable to the opposite side of the registration member 204.

In the registration apparatus 205, the vertical registration rod 206 is provided arcuate openings 201*a* which are so formed in advance in the individual sort bins 201 as to extend through all the sort bins 201. The registration rod 206 is connected at its two end portions to the individual oneend portions of arms 207 to be turned. The other end portions of the individual arms 207 are individually fixed on not-shown pins, which are connected to a rotary drive motor or the like so that they are turned.

As a result, the registration rod 206 is turned through the arms 207 so that the individual sheets, as discharged to and stacked on the sort bins 201, are moved toward and registered by the regulation member 204. The sheets thus registered are stapled, if necessary. For this stapling operation, a stapling unit 209 is arranged at one-corner portions of the individual sort bins 201 of the sorter 200. The stapling unit 209 is relieved from a predetermined stapling position, when the sort bins 201 are vertically moved, and is moved to the stapling position when in the stapling process.

In the sorter 200 provided with the sheet post-treating apparatus device such as the stapling function, as shown in FIG. 38, the imaged sheets, as delivered from the image forming apparatus, can be registered, when discharged to the sort bins 201 designated to the sorting destinations, by the registration apparatus 205 to have their one-side end edges arranged with the regulation member 204 on the sort bins 201. After completion of this registration, the sheets are stapled by the stapling unit 209, if necessary.

For the stapling operation or the like, according to the prior art thus far described, the bundles of sheets discharged and stacked on the individual sort bins 201 by the registration apparatus 205 or the discharge trays have to be arranged and registered by the registration member 204. Without satisfactory registration, the stapling operation, if done, cannot fix the stapling position. As a result, some sheets are left non-stapled and may fall down or may be left as they are, when the sheet bundles are removed from the sort bins 201. The unfixed stapling position gives an unsatisfactory appearance.

According to the registration apparatus 205 of the prior art, moreover, the sheets are registered such that they are pushed by the registration rod 206 to the regulation member 204, as opposed to the registration rod 206. As a result, the sheets may often fail to be arranged at their one-side end edges (e.g., their trailing ends) at the end portions to be stapled, especially on the side to confront the exit. Thus, there arises a trouble that the stapling state is not satisfactory.

The other end edges perpendicular to the one-side end edges could also be arranged if a second registration rod for pushing the sheets from the side opposed to the sheet trailing end portions were added to the registration rod 206. With this construction, however, it is necessary to additionally provide a registration apparatus for moving the second registration rod, so that the entire registration apparatus is large-sized to enlarge the post-treatment device as a whole and to raise the cost.

SUMMARY OF THE INVENTION

An object of the invention is to provide a sheet registration apparatus capable of registering sheets satisfactorily and to provide a sheet registration apparatus which has a simple registration mechanism and accordingly is of small size and low production cost.

In one aspect of the invention, there is provided a sheet registration apparatus comprising: a first regulation member for regulating and registering one-side edges of sheets; and a second regulation member for regulating and registering another-side edges of the sheets substantially perpendicular to the one-side edges, the second regulation member being perpendicular to the first regulation member, the sheets being moved to the first and second regulation members to be registered, the registration apparatus further comprising:

a registration member which carries out a first motion of transporting the sheets to the first regulation member to regulate and registrate the one-side edges of the sheets with the first regulation member, and a second motion of transporting the sheets to the second regulation member in association with the first motion to regulate and registrate the another-side edges of the sheets with the second regulation member.

With the construction according to the invention, when the registration member moves to the first regulation member and comes into contact with the sheets to be registered, the sheets are transported in the direction perpendicular to the moving direction, so that the sheets come at their individual end edges into abutment against the first and second regulation members, as arranged at a right angle with respect to each other, and are registered. As a result, the sheets are registered not only at their one-end edges but also at their another-end edges perpendicular to the one-end edges so that they can be registered to a satisfactory extent. Therefore, the post-treatment after the registration can be made accurately at the predetermined position. On the other hand, since the registration member is constructed to move in only one direction, the registration mechanism is not large-sized to contribute to size reduction of the sheet registration apparatus while preventing any rise in cost.

Preferably the registration member is adapted to move in a state of being inclined at least toward the second regulation member so as to transport the sheets to the first regulation member in the first motion and to turn to a sheet transporting direction where the sheets are transpoted to the second regulation member, in the second motion in relation to the first motion.

In the sheet registration apparatus having the aforementioned construction according to the invention, the registration member is adapted to move at an inclination at least toward the second regulation member so as to transport the sheets to the first regulation member by the first motion and to turn in the sheet transporting direction in relation to the movement by the second motion so as to transport the sheets to the second regulation member. As a result, the registration apparatus may be moved in one direction and turned so that the registration mechanism can be made relatively simply.

Preferably, the registration member continuously carries out the second motion of turning motion for a predetermined time period so as to transport the sheets to the second regulation member, while maintaining the sheets in a state of abutting against the first regulation member.

In the sheet registration apparatus having the aforementioned construction according to the invention, the registration member continuously carries out the second motion of turning motion for a predetermined time period so as to transport the sheets to the second regulation member, while maintaining the sheets in a state of abutting against the first regulation member. As a result, the sheets can be registered satisfactorily and reliably even in the case the sheets are electrostatically attracted to each other.

Preferably, the registration member moves ot turns at such a velocity that either the one-side edges or the another-side edges of the sheets may abut earlier against the first regulation member or the second regulation member.

In the sheet registration apparatus having the aforementioned construction according to the invention, the registration member moves or turns at such a velocity that either the one-side edges or the another-side edges of the sheets may abut earlier against the first regulation member or the second regulation member. Thereby the motion of transporting the sheets to the first or the second regulation member direction is stopped after the sheets abut against the first or the second regulation member to be regulated, and accordingly the damage suffered in registering by the sheets can be remarkably reduced.

Preferably, the first regulation member carries out a third motion of turning or moving in a direction where the sheets is transpoted to the second regulation member.

In the sheet registration apparatus having the aforementioned construction according to the invention, the first regulation member carries out the third motion to turn or move in the direction to transport the sheets to the second regulation member. As a result, the registration of the sheets can be enhanced. Since the first regulation member is disposed in this case, in the direction perpendicular to the second regulation member, the turning or moving mechanism can be simplified.

In another aspect of the invention, there is provided a sheet registration apparatus comprising: a first regulation member for regulating and registering one-side edges of sheets; and a second regulation member for regulating and registering the another-side edges of the sheets substantially perpendicular to the one-side edges, the second regulation member being perpendicular to the first regulation member, the sheets being moved to the first and second regulation members to be registered, the registration apparatus further comprising:

a registration member which moves and turns toward the first regulation member;

a moving member for turnably supporting and linearly moving the registration member toward the first regulation member; and turning means for turning the registration member on the moving member to a direction where the sheets are transported to the second regulation member.

With this construction according to the invention, when the registration member is to be moved linearly, for example, toward the first regulation member, it is turned at its individual positions. This construction makes the registration mechanism relatively simple. Especially since the moving member is provided with the registration member, the registration member may be turned on the moving member so that the registration mechanism can be simplified. By the single registration action, moreover, the sheets can be arranged to the first and second regulation members perpendicular to each other, so that the registration can be enhanced.

Preferably the sheet registration apparatus further comprises:

drive means for linearly moving the moving member;

a rotation transmission portion mounted on the moving member and rotatably connected to the registration member; and a stationary member fixed at a predetermined position in relation to a movement of the moving means, for rotating the rotation transmission portion.

In the sheet registration apparatus according to the invention are provided the drive means for moving the moving member linearly, the rotation transmission portion mounted on the moving member and connected rotatably to the registration member, and the stationary member fixed at a predetermined position in relation to the movement of the moving means for rotating the rotation transmission portion. Accordingly the registration member can be move and rotated with a single drive source and further the registration mechanisim can be simplified, which results in reduction in costs.

Preferably, the rotation transmission portion has a play portion for temporarily stopping the turn of the registration member to make the same unrotative when the rotation is transmitted from the rotation transmission portion to the registration member.

According to the invention, in the sheet registration apparatus having the aforementioned construction, the rotation transmission portion has the play portion for stopping the turn of the registration member temporarily to make the same unrotative when the rotation is transmitted from the rotation transmission portion to the registration member. As a result, the registration member leaves the sheets after the registration so that no delay occurs in the turns backward of the sheet registering direction when the registration member moves backward of the sheet registering direction. Thus, the registration member will not turn after it leaves the registered sheets, so that the sheet registration is not deteriorated.

Preferably, the registration member has such an abutment face against the sheets that is gradually inclined in a direction where the sheets are stacked.

In the sheet registration apparatus having the aforementioned construction according to the one or another aspect of the invention, since the registration member has the abutment face against the sheets which is gradually inclined in a direction where the sheets are stacked. As a result, the registered sheets are prevented, when the sheets stacked on the former are to be registered, from abutting against the registration member so that the damage of the sheets can be lightened. In the case the sheets are sorted and accommodated in the numerous sort bins or the like, the sheets can be registered not dispersedly but homogeneously.

According to the sheet registration apparatus thus far described according to the invention, the sheets can be registered on the side of the delivery direction and on the perpendicular side by the single registering operation of the simple registration mechanism.

As a result, it is possible to provide a sheet registration apparatus which can be small-sized as a whole without raising the cost.

Moreover, the registration member for registering the sheets is moved on one side toward one regulation member and turned on the other side to move the sheets to the regulation member on the perpendicular side. As a result, the registration mechanism can be simplified, and the sheets can be registered more reliably but without any electrostatic trouble.

By moving and turning the registration member by the common drive source, the size reduction in the sheet registration apparatus can be promoted to lower the cost.

Moreover, the sheets can be registered more satisfactorily by devising the registration member.

Moreover, the sheets can be transported by the registration member from one regulation member for the sheet registration to the other regulation member. This transportation can be simply made by arranging the two regulation members at a right angle.

BRIEF DESCRIPTION OF THE DRAWINGS

Other and further objects, features, and advantages of the invention will be more explicit from the following detailed description taken with reference to the drawings wherein:

FIG. 16 is a control flow chart showing a control procedure of the sheet registering operation including the sort control of the non-stapled sheets when the non-staple sort mode of FIG. 12 is set;

DETAILED DESCRIPTION OF THE PREFERRED EMBODIMENTS

Figure 1:
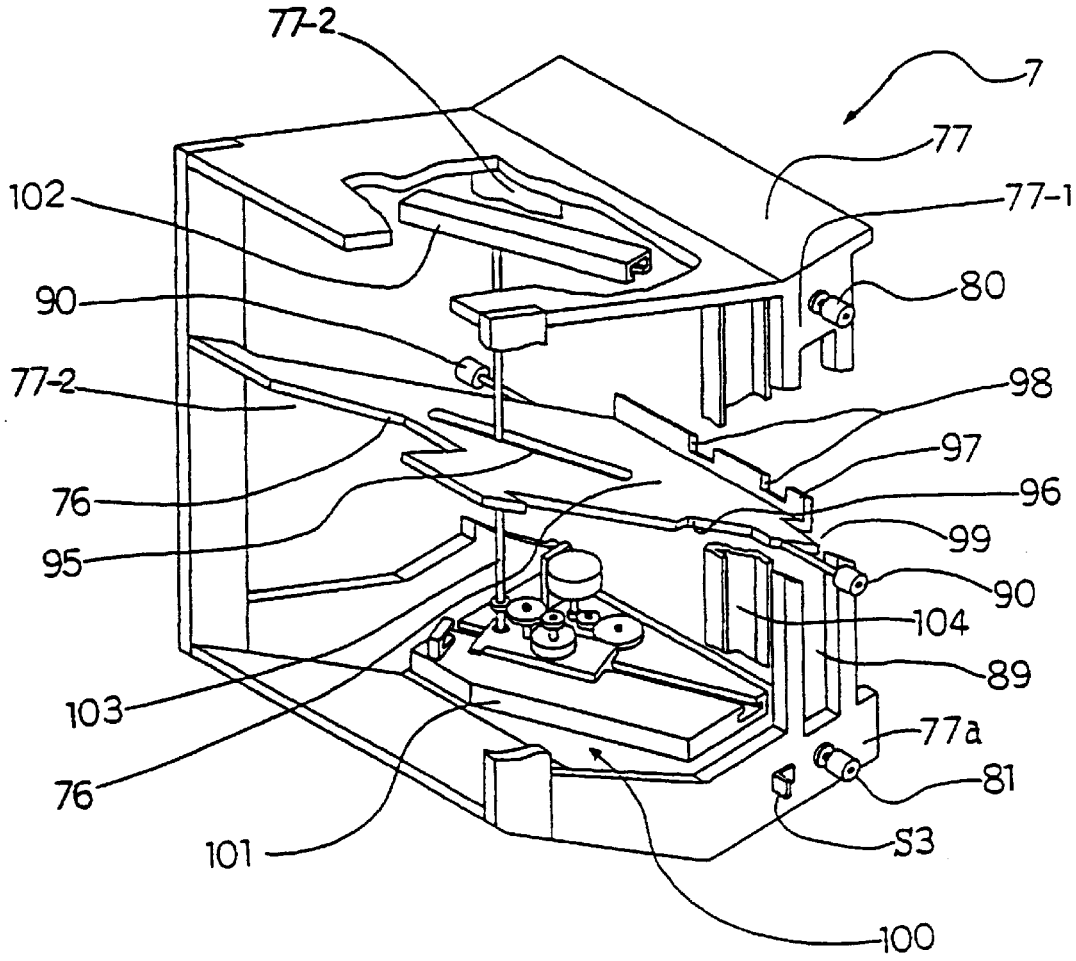
FIG. 1 is a perspective view showing an example, in which a sheet registration apparatus according to the invention is applied to a staple sorter 7 having a stapling function to post-treat the imaged sheets discharged from an image forming apparatus, and shows one sort bit 76 for receiving and registering the sheets.

Now referring to the drawings, preferred embodiments of the invention are described below.

FIG. 1 is a perspective view for explaining the structure of a staple sorter 7 which is equipped with a sheet registration apparatus of the invention as a sheet post-treating apparatus attached to an image forming apparatus. The sheet registration apparatus shown in FIG. 1 exemplifies the staple sorter 7 as the sheet post-treating apparatus and registers sheets P, as discharged to individual sort bins 76 composing the staple sorter 7. Here, FIG. 1 shows one sort bin 76 so as to simplify the description.

Figure 2:
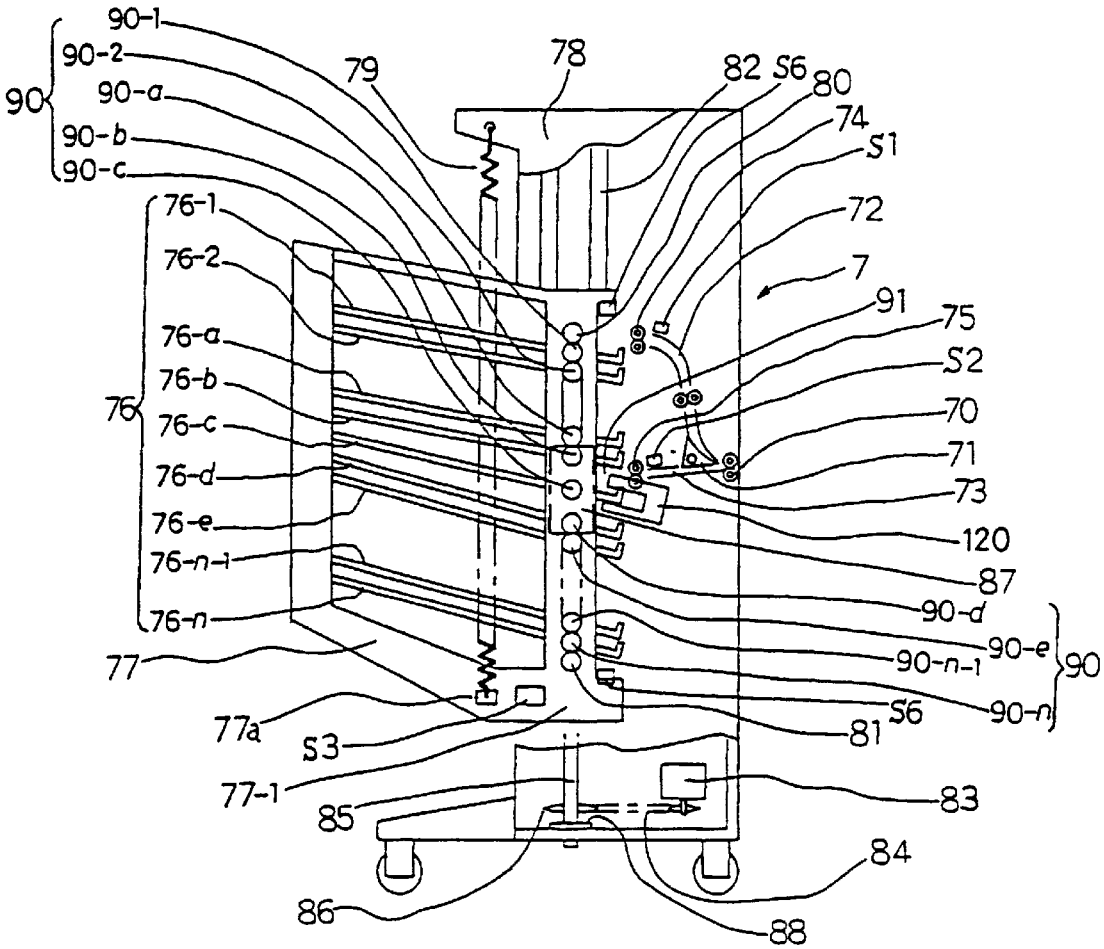
FIG. 2 is a side elevation showing the structure of the staple sorter 7 or the sheet post-treating apparatus shown in FIG. 1.

On the other hand, FIG. 2 is a side elevation showing the staple sorter 7 or the sheet post-treating apparatus of FIG. 1. Moreover, FIG. 3 is a diagram showing the state in which the staple sorter 7 equipped with the sheet registration apparatus of the invention shown in FIG. 1 is attached to an image forming apparatus such as a copying machine 1.

First of all, the entire structure of the copying machine 1 associated with the invention will be described with reference to FIG. 3.

Figure 3:
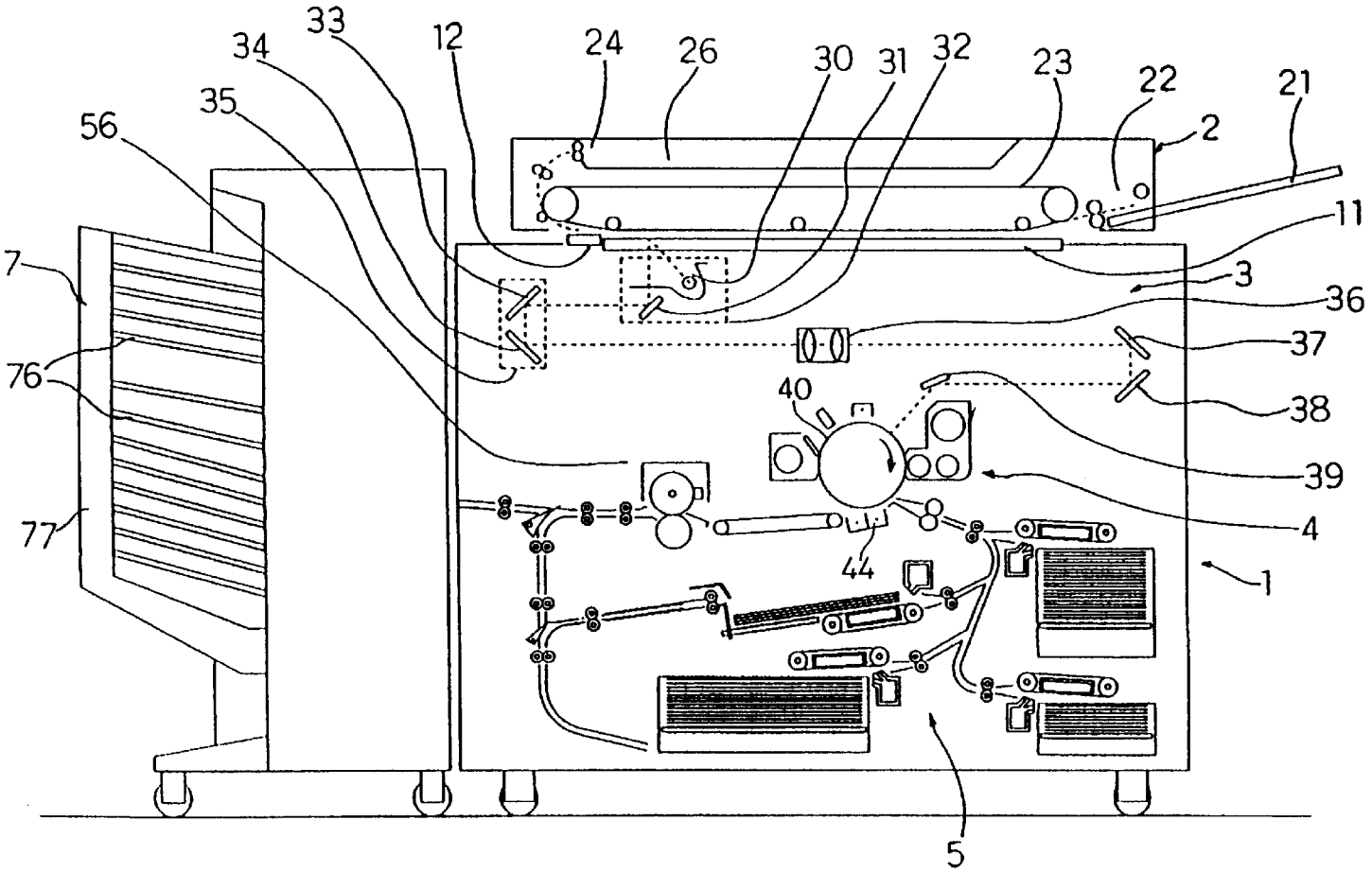
FIG. 3 is a diagram the state, in which the staple sorter 7 equipped with the sheet registration apparatus according to the invention is attached to a copying machine 1 or the image forming apparatus, and shows the entirety of the internal structure of the image forming apparatus.

The image forming apparatus is exemplified by the copying machine 1, as shown FIG. 3. However, the image forming apparatus should not be limited to the copying machine 1, but the invention can naturally be applied to image forming apparatuses such as printers, facsimile apparatuses or their composite devices combined with each other.

Over the body of the copying machine 1 shown in FIG. 3, there is arranged a document feeding unit 2. In the body of the copying machine 1, there is disposed an optical scanning unit 3 corresponding to the document feeding unit 2. At the center of the copying machine 1, there are arranged an image forming unit 4 for achieving the image of a document as a visible image, and a transport system 5 for transporting the sheets P of ordinary paper or the like to form the image by the image forming unit 4 on the sheets P. Moreover, the staple sorter 7 for receiving and post-treating the sheets, on which the image was formed by the image forming apparatus such as the copying machine 1, is arranged in place of the discharge tray at the lefthand side of the body of the copying machine 1.

The document feeding unit 2 shown in FIG. 3 feeds the documents, as stacked on a document tray 21 and separated one by one by a document separate feeder 22, onto a document bed 11, as made of transparent glass and placed at the uppermost position of the body of the copying machine 1, by the action of a document transport belt 23. At this time, the document is fed with its leading end toward a reference plate 12, as arranged at the reference position of the document bed 11, and is regulated to abut at its leading end against the reference plate 12. This transport of the document is interrupted at the instant when the leading end of the document comes into abutment against the reference plate 12.

When the document placed on the document bed 11 is scanned for exposure, the reference plate 12 is turned downward, and the document is transported by the document transport belt 23 and is discharged by discharge rollers 24 onto a document discharge tray 26 which is disposed over the document feeding unit 2.

Here will be described the optical scanning unit 3 which is disposed at an upper position in the body of the copying machine 1. This optical scanning unit 3 is constructed to include: a scanning unit 32 having an exposure lamp 30 for irradiating the document on the document bed 11 optically and a first mirror 31 integrated with the exposure lamp 30 for reflecting the reflected light from the document in a predetermined direction; a moving mirror unit 35 integrally supporting a second mirror 33 and a third mirror 34 for further reflecting the reflected light from the first mirror 31; a focusing lens 36 for magnifying and reflecting a light image of the reflected light on a photosensitive member making the image forming unit 4; and a fourth mirror 37, a fifth mirror 38 and a sixth mirror 39 for directing the light having passed through the focusing lens toward the photosensitive member.

In the optical scanning unit 3 thus constructed, the reflected light coming from the document when this document is irradiated by the exposure lamp 30 is guided to and focused as the document image on the photosensitive member, as will be described hereinafter, by the actions of the first mirror 31, the second mirror 33, the third mirror 34, the focusing lens 36, the fourth mirror 37, the fifth mirror 38 and the sixth mirror 39. At this time, the scanning unit 32 runs at a first speed V in parallel with the face of the document bed 11, and the moving mirror unit 35 runs at a second speed of V/2 in the same direction as that of the scanning unit 32. As a result, the image on the document is sequentially focused on the photosensitive member, that is, optically scanned and focused.

Here will be described the imaging foming unit 4 and the transport system 5. This image forming unit 4 is equipped at its center with a photosensitive member 40 or an image carrier, on which the image of the document by the optical scanning unit 3 is focused, as described above. This photosensitive member 40 is formed into a drum shape, for example, and there are arranged in the turning direction around the photosensitive member 40 a variety of imaging process means for forming the image.

These imaging process means will be described in the following. Around the photosensitive member 40 and in the turning direction (as indicated by arrow) of the photosensitive member 40, as shown in detail in FIG. 4, there are arranged the process means including a charger 41, an exposing optical path 42, a developer 43, a transferor 44, a peeling discharger 45, a cleaning device 46 and a static eliminator lamp 47.

The charger 41 charges the surface of the photosensitive member 40 uniformly by supplying a charge of a predetermined polarity to the surface of the photosensitive member 40 turning clockwise, as shown. The photosensitive member 40 thus uniformly charged is irradiated on its surface, when it comes to the exposing optical path 42, with the optical image by the optical scanning unit 3 so that an electrostatic latent image corresponding to the original image is formed. When the surface of the photosensitive member 40 having the electrostatic latent image goes to a position confronting the developer 43, moreover, a developing agent such as toner having the polarity opposite to that of the charge of the electrostatic latent image is electrostatically applied by the developer 43 to the surface of the photosensitive member 40 to form a visible image (or a toner image).

When the toner image corresponding to the image of the document is formed on the surface of the photosensitive member 40, as described above, and comes to the position confronting the transferor 44, it is electrostatically transferred to the sheets P which are suitably transported by the transport system 5, as will be described hereinafter. Specifically, the charge of the same polarity as that on the surface of the photosensitive member 40 is applied to the back of the sheet P transported by the transferor 44, and the toner image is attracted to the sheet P in close contact with the photosensitive member 40 so that it is transferred to the sheet P from the surface of the photosensitive member 40.

The peeling discharger 45, as arranged adjacent to the transferor 44, applies the charge of the opposite polarity to that of the charge to e applied to the transferor 44 and eliminates the charge from the back of the sheet P closely contacting with the photosensitive member 40, to lower the adhesion thereby to peel the sheet P while carrying the toner image from the surface of the photosensitive member 40.

The toner image is partially left, even transferred to the sheet, on the surface of the photosensitive member 40. The toner thus left is eliminated, when it comes to a position confronting the cleaning device 46, from the surface of the photosensitive member 40. When the surface of the photosensitive member 40 thus cleared of the residual toner comes to the position of the static eliminator lamp 47, it is irradiated with a static eliminating light from the static eliminator lamp 47 so that the surface of the photosensitive member 40 is set to a generally homogeneous low potential (e.g., 0 potential) and prepared for a next image formation.

Here will be described the construction of the sheet transport system 5 for transporting the sheets P to a transfer portion, in which the photosensitive member 40 and the transferor 44 confront each other, of the image forming unit 4 so that the transferred sheets P are discharged after peeled from photosensitive member 40.

The sheet transport system 5, as disposed below the body of the copying machine 1, is divided into the transport to the transfer position, in which the photosensitive member 40 and the transferor 44 confront, and the transport of the sheets peeled after transferred from the photosensitive member 40.

First of all, the sheet transport system 5 to the transfer position is constructed to include: a container 50(50*a*, 50*b* and 50*c*) for the sheets P; a feeder 51 (51*a*, 51*b* and 51*c*) for separating the contained sheets P pneumatically and for feeding the separated sheets P; a lift plate 52 (52*a*, 52*b* and 52*c*) for stacking the contained sheets P to position the uppermost sheet always at a predetermined height; and transport rollers 53 (53*a*, 53*b* and 53*c*) and synchronous transport rollers (or resist rollers) 54 for transporting the sheets P to the transfer position.

Moreover, the transport system 5 after the transferred sheets P are peeled from the photosensitive member 40 is constructed to include a transport belt 55, a fixing device 56, a discharge passage 57 and discharge rollers 58.

Midway of the discharge passage 57, moreover, there is arranged a switch gate 59 for switching the passage to guide the sheets P to a re-transport passage 60 for forming the image on both sides of the sheets P, in dependence upon the switching position of the switch gate 59. The re-transport passage 60 is equipped with transport rollers 61, a switch gate 62, reciprocal rollers 63, a reverse passage 64, transport rollers 65 and a two-side tray 66. This two-side tray 66 is equipped a feeder 67 of a pneumatic separation type for feeding the contained sheets P having the image to the resist rollers 53, and transport rollers 68.

In this construction of the transport system 5, the sheets P are contained in the container 50, and the sheets P are lifted to a position for the feeder 51 to feed one sheet P as the lift plate 52 rises, so that the sheet P is fed to the transport rollers 53 by the feeder 51. The sheet P is fed from the transport rollers 53 to the resist rollers 54 arranged just upstream of the photosensitive member 40. At this time, the sheet P, as transported to the resist rollers 54, is arranged to have its leading end in parallel with the axis of rotation of the photosensitive member 40 and is transported toward the transfer position to the photosensitive member 40 while being synchronized with the leading end of the toner image formed on the surface of the photosensitive member 40. As a result, the toner images, as formed on the surface of the photosensitive member 40 by the image forming unit 4, are sequentially transferred to the sheets P by the actions of the transferor 44.

Next, the transferred sheets P are separated from the photosensitive member 40 and are transported by the fixing device 56 by the transport belt 55 with their backs being pneumatically sucked. The sheets P having passed through the fixing device 56 are fixed with the toner images carried on their upper faces and are discharged via the discharge passage 57 and through the discharge rollers 58 to the outside of the copying machine 1.

When images are to be formed on both the sides of the sheets P, on the other hand, the sheets P are not discharged but transported along the re-transport passage 60 to the reverse passage 64 by the transport rollers 61 and the reciprocal rollers 63 because the passage is switched to the re-transport passage 60 by the switch gate 59 disposed midway of the discharge passage. The sheets P thus transported to the reverse passage 64 are detected at their trailing ends, when they passes through the position of the switch gate 62, and the reciprocal rollers 63 are driven backward in response to the detection so that the sheets P are delivered to the two-side tray 66 through the transport rollers 65.

In the case the images are to be thus formed on both the sides, the sheets P are sequentially transported via the re-transport passage 60 and stacked on the two-side tray 66. Moreover, the sheets P thus temporarily contained on the two-side tray 66 are separated and fed one by one by the feeder 67 and are fed again to the resist rollers 54 through the transport rollers 68. As a result, the images are formed on the two sides of the sheets P, and these sheets P are then discharged through the fixing device 56, the discharge passage 57 and the discharge rollers 58 to the outside of the body of the copying machine 1.

Thus, the sheets P are discharged, after the image is formed on one side thereof, to the outside of the body of the copying machine 1 through the discharge rollers 58, or likewise discharged, after the images are formed on the two sides of the same, to the outside of the body of the copying machine 1 through the discharge rollers 58. This discharge portion is confronted by the staple sorter 7 which is equipped with the sheet registration apparatus of the invention. In short, the staple sorter 7 is provided with a receiving port for the sheets P to be discharged, so that the imaged sheets P are fetched into the staple sorter 7 through the delivery rollers which are arranged to confront the receiving port.

Here, the fixing device 56 heats and presses the sheets P, which carry the non-fixed toner images formed by the image forming unit 4, by passing them between a heat roller 56*a* and a pressure roller 56*b*, thereby to melt, fuse and fix the toner on the sheets.

Here will be described the structure of the staple sorter 7 attached to the copying machine 1 thus constructed, before the description of the various embodiments of the sheet registration apparatus of the invention to be attached to the staple sorter 7.

Structure of Staple Sorter 7

The structure of the sheet post-treating apparatus provided with the sheet registration apparatus of the invention will be described with reference to FIGS. 1 and 2. This sheet post-treating apparatus will be described by way of an example of the sorter capable of receiving the imaged sheets P discharged from the copying machine 1 and sorting the sheets P, if necessary, and the staple sorter 7 having the stapling function to perform the stapling operation at the final post-treating step after the completion of the sheet registration.

First of all, here will be described the structure of the sheet post-treating apparatus of the invention, that is, the staple sorter 7 given the stapling function, with reference to FIG. 2.

Figure 4:
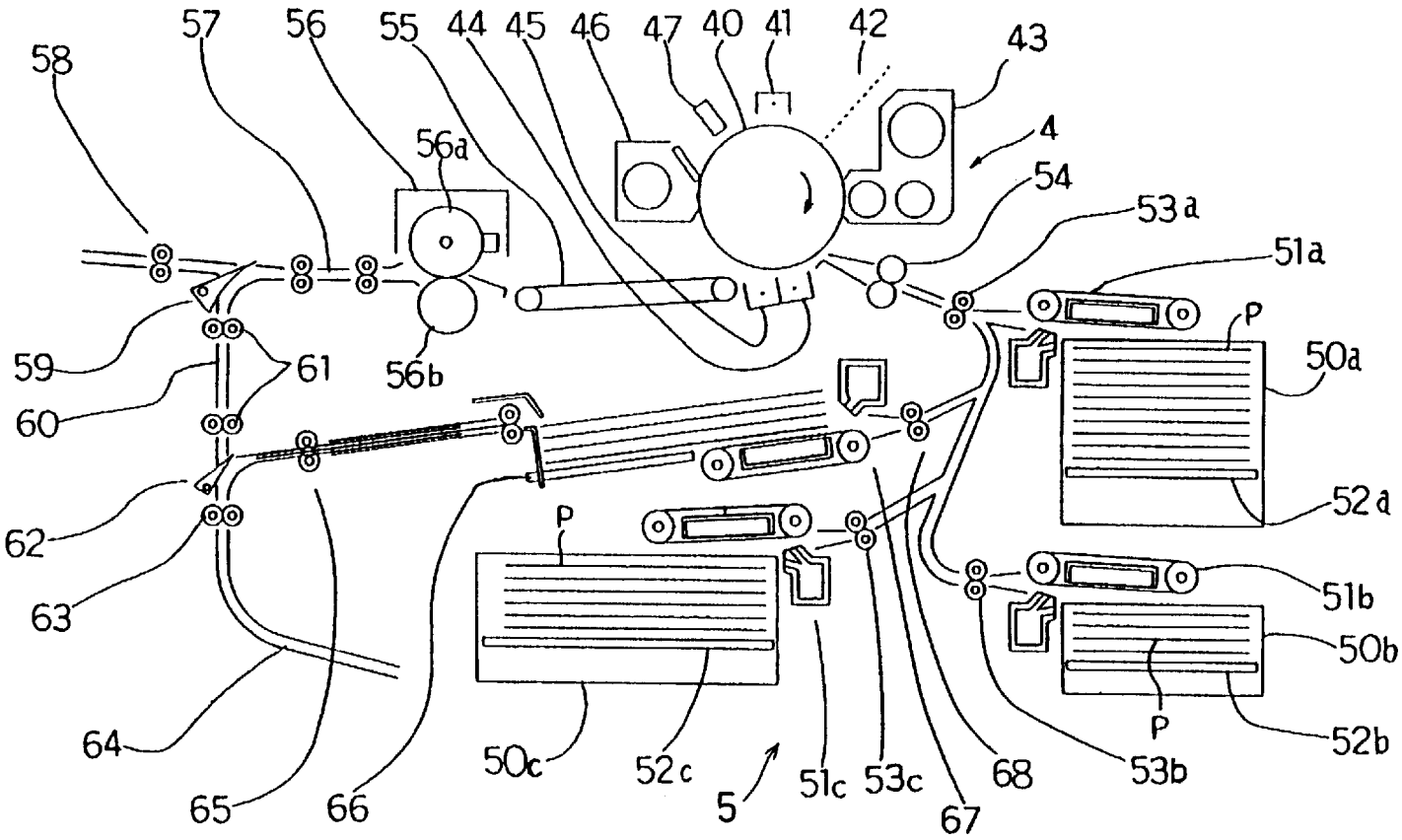
FIG. 4 is a diagram showing an essential portion of the image forming portion of FIG. 3, especially an image forming unit 4 and a transport system 5 for feeding sheets P to the image forming unit 4 and for discharging the imaged sheets.

At a position to correspond to the delivery port, as formed to confront the discharge port on the side of the body of the copying machine 1, of the staple sorter 7, as shown in FIG. 2, there is arranged a delivery rollers 70, which delivers the sheets P, as delivered out of the body of the copying machine 1 by the discharge rollers 58 shown in FIG. 4, into the staple sorter 7. Downstream of the delivery of the delivery rollers 70, there is arranged a switch gate 71 which is actuated and controlled by a (not-shown) gate solenoid. The switch gate 71 switches the individual transport passages (or paths) to lead the sheets to a non-sort path 72, when the gate solenoid is off, or to a sort path 73 when the gate solenoid is on.

Non-sort discharge rollers 74 are arranged at the end portion of the non-sort path 72, and a non-sort discharge sensor S1 is arranged in the vicinity of the delivery upstream side of the non-sort path 72.

Moreover, sort discharge rollers 75 are arranged at the end portion of the sort path 73, and a sort discharge sensor S2 is arranged in the vicinity of the upstream side in the delivery direction. Thus, whether or not the sheets P are to be shorted is determined by means of a key which is disposed on a not-shown control panel for selecting and instructing the non-sort mode or the sort mode. Then, the switch gate 71 is switched in response to the action of the instruction key by the not-shown gate solenoid.

When the non-sort mode is selected, more specifically, the switch gate 71 is switched to guide the sheets P to the non-sort path 73 so that the sheets P are discharged the non-sort discharge rollers 74. This discharged position is confronted by the uppermost sort bin 76, to which the sheets P are discharged and sequentially stacked. When the sort-mode is selected and instructed, moreover, the switch gate 71 is switched to guide the sheets P to the sort path 73 so that the sheets P are discharged from the sort discharge rollers 75.

A number of sort bins 76-1 to 76-n including the aforementioned uppermost one are positioned to correspond to the sort discharge rollers 75 or the non-sort discharge rollers 74. For this positioning, the sort bins 76-1 to 76-n are vertically moved by a lift mechanism, as will be described hereinafter.

Sort Bin Lift Mechanism of Staple Sorter 7

The sort bin 76 is composed of the bins 76-1 to 76-n which are stacked and individually moved up and down. Each sort bin 76 is supported in an integral unit by a support member 77 so that each unit, i.e., each support member 77 can be vertically moved. For this vertical movement, the support member 77 is retained at its bottom portion 77*a* by the other end side of a support spring 79 which is fixed at its one end on a frame 78 of the staple sorter 7, so that it is ordinarily biased to rise by the biasing force of the support spring 79. The load of the support member 79 is so designed as to support the weights of the support member 77 including the sort bin 76 and the sheets P accommodated in the support member 77.

On the upper portions and the lower portions of frames 77-1 and 77-2 of the two side faces of the support member 77, respectively, there are rotatably supported guide rollers 80 and 81, which are rotatably fitted in a roller guide 82 which is fixed on the frame 78 of the staple sorter 7 and extended vertically. The upper and lower guide rollers 80 and 81 roll in the roller guide 82, while the support member 77 united with the sort bin 76 is moving up and down, so that the support member 77 is vertically guided in a stable state. Moreover, the support member 77 is ordinarily biased to rise by the biasing force of the support spring 79.

In the lower portion of the frame 78 of the staple sorter 7, on the other hand, there is arranged a drive motor 83 for lifting the support member 77. The driving force of this drive motor 83 is connected through transmission means such as a chain 84 to a sprocket 86 fixed on a lead cam shaft 85, thereby to rotate the sprocket 86. As a result, the lead cam shaft 85 is rotated to turn a lead cam 87 which is fixed generally at the center of the lead cam shaft 85.

The upper and lower end portions of the lead cam shaft 85 are rotatably supported by thrust bearings 88 which are disposed at the upper and lower portions of the frame 78. Moreover, the drive motor 83 for moving each sort bin 76 up and down can rotate forward and backward to turn the lead cam 87 forward and backward.

Between the guide rollers 80 and 81 which are rotatably supported by the two side frames 77-1 and 77-2 of the support member 77, as shown in FIG. 1, there is formed a vertically elongated guide opening 89. Through this guide opening 89 and outside of the two side frames 77-1 and 77-2 of the support member 77, there is protruded a bin roller 90 which is rotatably supported on the side portions of the roots of the multiple sort bins 76-1 to 76-n arranged in the support member 77 shown in FIG. 2. The multiple sort bins 76 are vertically movably disposed in the support member 77. In FIG. 1, only one sort bin 76 is shown so as to prevent the illustration from being complicated and to simplify the description.

As shown in FIG. 2, the bin roller 90, as provided for the aforementioned vertical movements, is rotatably fitted like the upper nd lower guide rollers 80 and 81 by the roller guide 82. The bin roller 90-n of the lowermost sort bin 76-n is placed on the lower guide roller 81, and the individual bin rollers 90-n-1 to 90-1 of the upper sort bins 76-n-1 to 76-1 are sequentially stacked on the bin roller 90-n. Midway of this stack, there is positioned the lead cam 87, at which the individual bin rollers 90 are separated such that the sort bin 76-c is positioned to confront the sort discharge rollers 75, as shown in FIG. 2, to receive the sorted sheets P discharged.

Figure 5:
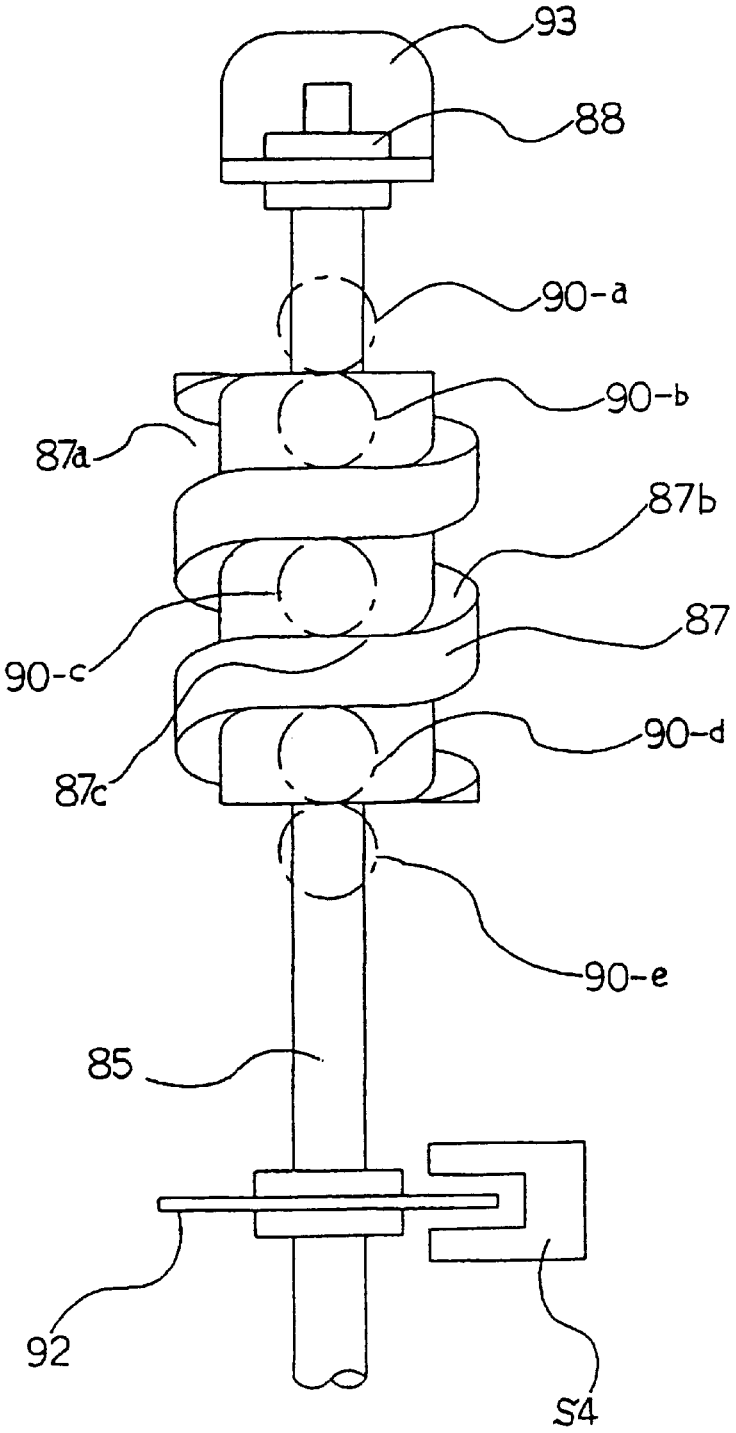
FIG. 5 is a side elevation showing the detail of a lead cam 87 which is rotationally driven to vertically move the individual sort bins 76 receiving the sheets.

The vertical movements of the individual sort bins 76 for sorting the sheets P can be understood by describing in detail the lead cam 87 for moving the individual sort bins 76 vertically. In the lead cam 87 which is fixed generally at the center of the lead cam shaft 85, as shown in FIG. 5, there is formed a cam groove 87*a* which is made helical on the cam axis and which is slightly wider than the diameter of the bin rollers 90. This lead cam 87 comes, when it turns, into engagement with the cam groove 87*a* of the bin roller 90-c of the sort bin 76-c, as positioned to confront the sort discharge rollers 75, to move the sort bin 76-c vertically. The bin roller 90 is made so rotatable with respect to the sort bin 76 that no torque may be transmitted from the bin roller 90 to the sort bin 76 by the turns of the lead cam 87.

On the lead cam 87, as shown in FIG. 2, there are sequentially placed the bin rollers 90-a, - - - , 90-2 and 90-1 of the sort bins 76-a, - - - , 76-2 and 76-1 over the sort bin 76-b, for example. Here, the upper guide roller 80 is positioned over the bin roller 90-1.

When the lead cam 87 thus constructed makes one turn in the direction to move the bin rollers 90 upward, for example, the positions of the bin rollers 90-e, 90-d, 90-c and 90-b are shifted to those of the upper bin rollers 90-d, 90-c, 90-b and 90-a, as shown in FIG. 2. In short, the bin rollers 90 are moved up by one step. At this time, the bin rollers 90, as moved upward of the lead cam 87 by the lead cam 87, push their upper bin rollers 90 and accordingly the upper guide roller 80. As a result, the sort bins 76 simultaneously move upward so that the support member 77 accommodating the individual sort bins 76 as a unit moves upward.

As the support member 77 moves, moreover, the lower guide roller 81 pushes the lower bin rollers 90 of the lead cam 87 into abutment against the lead cam 87 so that the lead cam 87 can bring the more lower bin rollers 90 into the cam groove 87*a*. Moreover, the lowermost bin roller 90-n can be moved to over the lead cam 87. At this time, the support spring 79, as retained on the bottom portion 77*a* of the support member 77, supports the support member 77 so that the load on the lead cam 87 can be lightened to left the support member 77 easily.

When the lead cam 87 makes one turn to lower the bin rollers 90, on the contrary, the positions of the bin rollers 90-a, 90-b, 90-c and 90-d of FIG. 2 move to those of the individually lower bin rollers 90-b, 90-c, 90-d and 90-e. At this time, the bin rollers 90, as moved to below the lead cam 87 by the lead cam 87, push the further lower bin rollers 90 to push the lower guide roller 81. As a result, the sort bins 76 move downward so that the support member 77 also moves downward. As the support member 77 moves downward, the upper guide roller 80 pushes the upper bin rollers 90 of the lead cam 87 into abutment against the lead cam 87. Moreover, this lead cam 87 can bring the further upper bin rollers 90 into the cam groove 87*a* so that the uppermost bin roller 90-1 can be moved to under the lead cam 87.

In the bottom portion 77*a* of the support member 77, on the other hand, there is mounted a support member home position sensor S3 of the photo interrupter type. When a (not-shown) detection plate disposed on the side of the frame 78 of the staple sorter 7 is passed, the output signal of the support member home position sensor S3 is switched to detect the home position of the support member 77. The detection plate is disposed in a fixed state on the side of the frame 78 of the staple sorter 7 and in the lower portion of the frame 78.

Here, the vertical movements of the support member 77 are controlled by the detection of the home position of the support member 77 with the support member home position sensor S3 and by the turns of the lead cam with a later-described lead cam sensor S4.

Between the sort bin 76-c, as confronted by the sort discharge rollers 75 as the bin rollers 90 are moved by the lead cam 87, and the upper bin 76-b, moreover, there is formed an opening 91 which is wider than that between the remaining sort bins. This opening depends upon the gap between the cam grooves 87*a* of the lead cam 87 so that the sheets P discharged can be reliably accommodated in the sort bins 76.

Turn Control of Lead Cam 87

Figure 6:
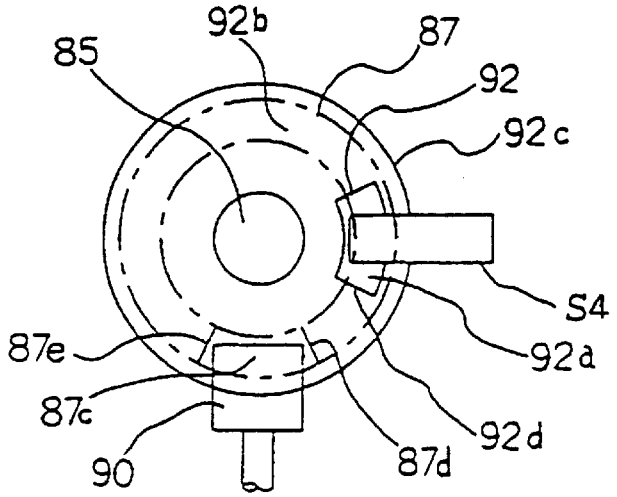
FIG. 6 is a top plan view showing the lead cam 87 of FIG. 5 from the top.

With reference to FIGS. 5 and 6, here will be described in detail the turning control of the lead cam 87 for sorting and accommodating the sheets P in the individual sort bins 76 and the vertical control of the sort bins 76 by the turning control.

FIG. 5 is a side elevation of the main parts around the lead cam 87 thus far described, and FIG. 6 is a top plan view of the main parts around the lead cam 87.

As shown in FIG. 5, the structure of the lead cam 87 will be described in more detail. The cam groove 87*a* is composed of a helical slope portion 87*b* and a parallel portion 87*c* for causing the bin roller 90 to stand still. While this lead cam 87 is turning, the bin roller 90 engaging with the cam groove 87*a* is moved upward or downward by the slope portion 87*b* and is held still in a play state by the parallel portion 87*c*.

On the lead cam 85, there is so fixed a detection plate 92 as to turn together. The photo interrupter type lead cam sensor S4 is arranged at a position to confront the detection plate 92. The sensor S4 is located on the side of the frame 78 of the staple sorter 7.

As a result, when the lead cam 87 is turned by the rotation of the drive motor 83, as described with reference to FIG. 2, the associated detection plate 92 is also turned so that one turn of the lead cam 87 and the stop position of the lead cam 87 are detected by the lead cam sensor S4. Here, a holding frame 93 for supporting the upper end portion of the lead cam shaft 85, as shown in FIG. 5, is fixed on the frame 78 of the staple sorter 7 to hold the upper thrust bearing 88 pairing the lower thrust bearing 88 of the lead cam shaft 85 of FIG. 2 thereby to support the lead cam shaft 85 rotatably.

With subsequent reference to FIGS. 5 and 6, here will be described the turning control of the lead cam 87 by the detection actions of the lead cam sensor S4 and the detection plate 92.

The detection plate 92 is composed of a detection opening 92*a* formed in a portion of a flat disc and a shielding portion 92*b*. The detection plate 92 is so adjusted that the bin roller 90 may be positioned at the two ends 87*d* and 87*e* of the flat portion 87*c* of the lead cam 87 when the two end edges 92*c* and 92*d* of the detection opening 92*a* in the turning direction are detected by the lead cam sensor S4.

The lead cam sensor S4 sends output signals, which are different for the detection opening 92*a* and the shielding portion 92*b*, to a (not-shown) control unit. On the basis of this output signal, the control unit controls the drive motor 83 to control the turns of the lead cam 87. At this control, the output signal level of the lead cam sensor S4 is switched at the two end edges 92*c* and 92*d* of the detection opening 92*a* so that the parallel portion 87*c* of the lead cam 87 is stopped at the bin rollers 90. Alternatively, the turn of the lead cam 87 is controlled so that the bin rollers 90 may move up or down while engaging with the slopes 87*b* of the lead cam 87.

Figure 7:
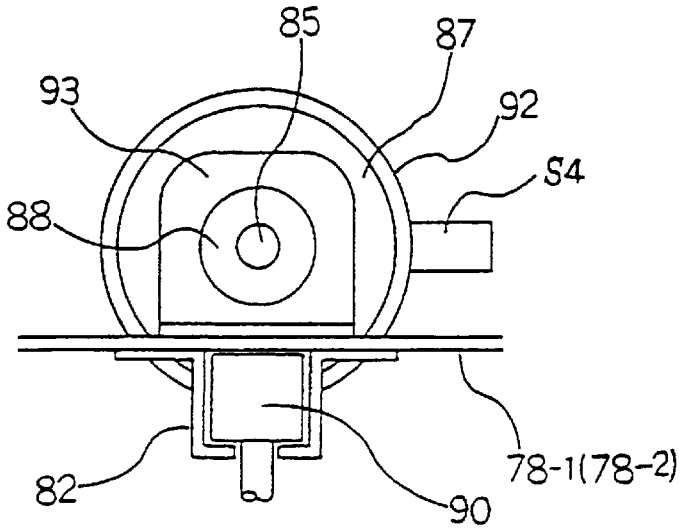
FIG. 7 is a top plan view showing the lead cam 87 and a detector for controlling the rotation of the lead cam 87.

Here, FIG. 7 is a top plan view of FIG. 5 and shows the state, in which the bin rollers 90 are guided by the roller guide 82, and the state in which the holding frame 93 holding the roller guide 82 and the lead cam shaft 85 is mounted on frames 781 and 78-2 at the two sides of the frame 78 of the stationary staple sorter 7.

As has been described hereinbefore, the sheets P having the images formed by the copying machine 1 are delivered to the staple sorter 7 of the sheet post-treating apparatus so that they are discharged to any necessary one of the sort bins 76. In the state where the non-sort mode is selected, more specifically, the uppermost bin 76-1 of the sort bins 76 is selected to position the support member 77 in the state shown in FIG. 2. In other words, the home position sensor S3 detects the home position of the support member 77 to make a control to a rise of a predetermined step number so that the uppermost bin 76-1 is brought to confront the non-sort discharge rollers 74.

In this state, the imaged sheets P are sequentially stacked on the bin 76-1.

When the sort mode is selected, the lead cam 87 is so turned downward from the state of FIG. 2 by the drive motor 83 that the uppermost bin 76-1 may confront the sort discharge rollers 75, thereby to move the support member 77 downward as a whole. When the home position sensor S3 detects the state in which the support member 77 is lowered to the home position, more specifically, the uppermost sort bins 76-1 takes a position to confront the aforementioned sort discharge rollers 75.

Moreover, the lead cam 87 is turned to the direction to raise the sort bins 76 by one step each time one sheet P is discharged to the uppermost bin 76-1. When a set number (m) of sheets P are discharged until the last sheet P is discharged to the corresponding sort bin 76-m, moreover, this sort bin 76 is held in that position. When the sheets P having the image of the next page document are discharged to the sort bin 76-m, the lead cam 87 is then turned upward so that the sheets P are sequentially stacked and sorted in the order of pages on the individual sort bins 76.

Here will be described the various embodiments of the sheet registration apparatus of the invention for registering the imaged sheets P which are sequentially discharged to and stacked on the individual sort bins 76.

First Embodiment

The first embodiment of the sheet registration apparatus according to the invention will be described with reference to FIG. 1.

In the support member 77 made vertically movable and having the united sort bins 76, as shown in FIG. 1, there is arranged a sheet registration apparatus 100 which is extended from the lower to upper portions of the support member 77. The portion of the sheet registration apparatus 100, as arranged under the support member 77, is a registration drive portion 101 for the sheet registration. The portion of the sheet registration apparatus 100, as arranged over the support member 77, is a registration guide portion 102 for the sheet registration.

Figure 8:
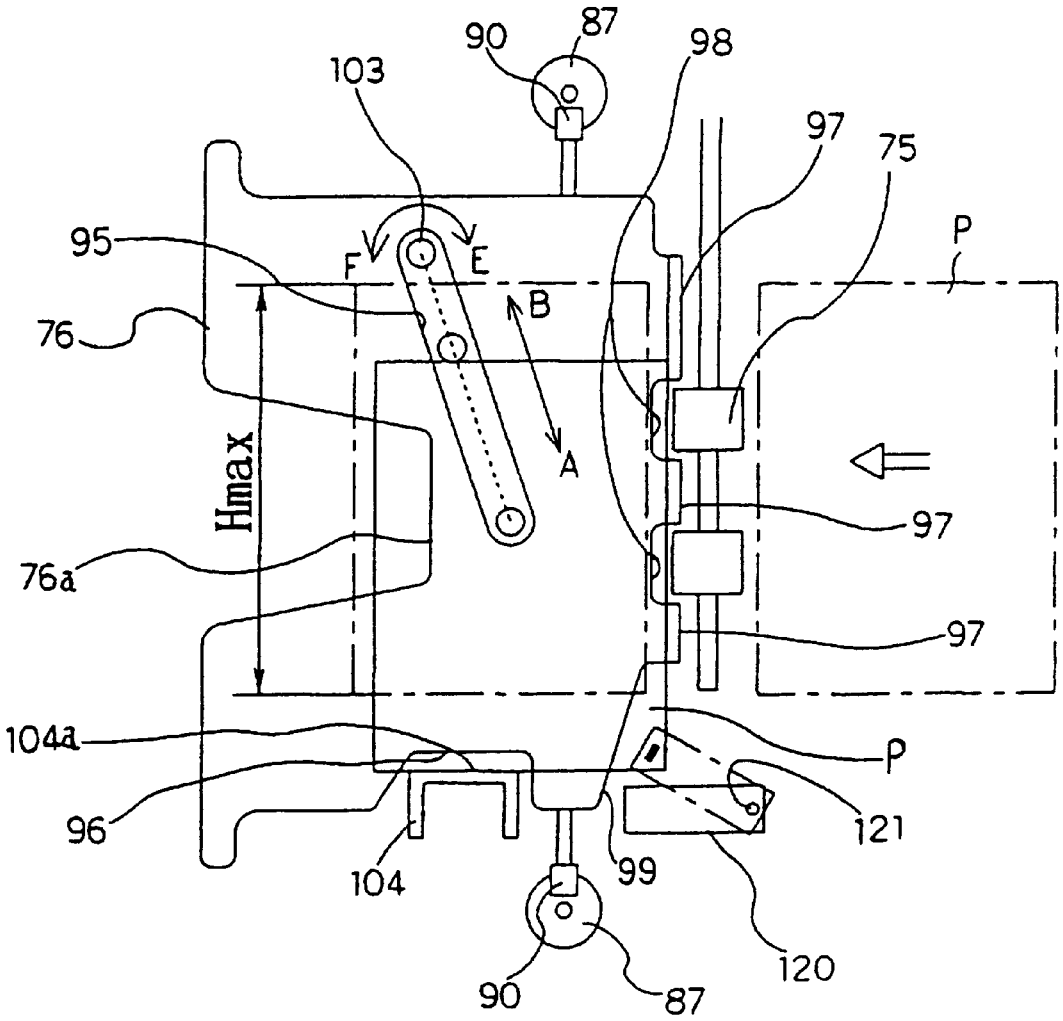
FIG. 8 is a top plan view showing the sort bin 76 for receiving the sheets so as to explain the control and operation of the sheet registration of a first embodiment of the invention.

Between the registration drive portion 101 and the registration guide portion 102, there is interposed a registration rod 103 which is extended through openings 95 formed with an inclination at identical positions in the individual sort bins 76. By the registration drive portion 101, moreover, the registration rod 103 is made movable in the sloped opposite directions A and B, as shown in FIG. 8, along the longitudinal direction of the openings 95. In the individual sort bins 76 stacked, there are formed registration relieves (or recesses) 96 which are located at the identical positions of this side of FIG. 8. In a manner to correspond to the recesses 96, there are provided registration plates 104 for regulating the one-side end edges of the sheets P, as located at a right angle with respect to the discharging direction (or the delivering direction) of the sheets P. The regulating plate 104 is formed to have a generally C-shaped section and is fixed at its upper and lower end portions on the ceiling and bottom of the support member 77.

Moreover, the registration face 104*a* of the registration plate 104 regulates the movement of the one-side end edge of the sheets P to register the sheets P, when it pushes the sheets P to the direction perpendicular to their discharging direction as the registration rod 103 moves to the direction A. Thus, the registration face 104*a* provides a registration reference at a right angle with respect to the discharging direction of the sheets P.

The registration reference in the discharging direction, as perpendicular to the registration reference position of the sheets P by the registration plate 104, is provided by a reference wall 97 which is erected integrally with the sort bins 76 at the trailing end portions of the sort bins 76 in the discharging direction. In the reference wall 97, there are formed roller relieves 98 which are recessed to arrange the sort discharge rollers 75 adjacent to each other and to prevent the sheets P from being caught by the reference wall 97 so that the sheets P may be reliably discharged to the sort bins 76. As a result, when the sort bins 76 come to confront the sort discharge rollers 75 or the non-sort discharge rollers 74, the rollers 75 come partially into the relieves 98 to discharge the sheets P onto the faces of the bins 76.

On the other hand, the sort bins 76 are provided with: a staple relief 99 for later stapling the bundle of sheets P stacked on the sheet faces of the individual sort bins 76 by means of a stapling unit 120; and a center recess 76*a* for allowing the user to take out the bundle of sheets P stacked on the sheet face with ease.

Here will be described the detail of the structure of the sheet registration apparatus 100 with reference to FIG. 9. The registration drive portion 101 constructing the sheet registration apparatus 100 is mounted on a drive plate 105 which is fixed on the bottom plate of the support member 77. In the drive plate 105, there is formed a grooved rack guide 106. In this rack guide 106, there is movably fitted a moving rack 107 which has rack teeth on its one side. On the moving rack 107, there is fixed a registration rotary motor 108 or a stepping motor, which has a gear 109 connected directly to the rotary shaft thereof.

Over the moving rack 107, on the other hand, there is disposed an input gear 110 which is rotatably supported and meshed with the gear 109 mounted on the rotary shaft of the motor 108. On the moving rack 107, moreover, there is held one thrust bearing 111 which supports the stem 103*a* of the registration rod 103 rotatably. On the stem 103*a* of the registration rod 103, there is fixed a drive gear 112 which meshes with the input gear 110. As a result, when the registration rotary motor 108 rotates in the opposite direction C or D, as shown in FIG. 9, the registration rod 103 turns to the opposite direction E or F through the gears 109, 110 and 112.

Moreover, the moving rack 107 meshes with an input gear 113 which is rotatably supported on the drive plate 105. On the deep side of the moving rack 107, more specifically, there is integrally molded the rack gear which meshes with the input gear 113.

Moreover, the input gear 113 meshes with an intermediate gear 114 which is rotatably supported by the drive plate 105 and which is connected to a motor gear 116 fixed on the output shaft of a registration drive motor 115 or a stepping motor. This registration drive motor 115 is fixed on a holder 117 which is fixedly supported on the drive plate 105.

Figure 9:
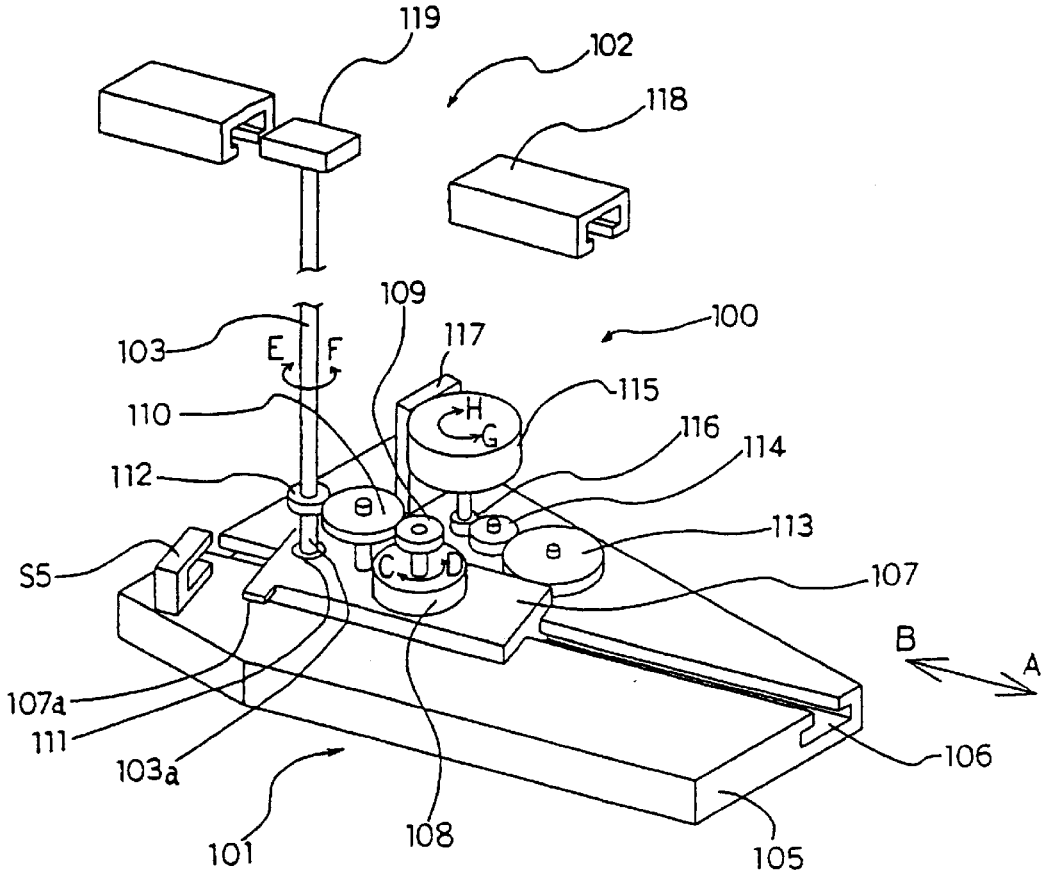
FIG. 9 is a perspective view showing the entire structure of a sheet registration apparatus 100 according to the first embodiment of the invention.

In the moving rack 107 thus constructed, when the registration drive motor 115 rotates in the opposite direction G or H, as shown in FIG. 9, the driving force of the registration drive motor 115 is transmitted through the motor gear 116 and the intermediate gear 114 to the input gear 113 thereby to move the moving rack 107 along the rack guide 106 to the opposite direction A or B, as shown.

On the drive plate 105, on the other hand, there is arranged a registration home position sensor S5 for detecting the home position of the registration rod 103 by detecting the actuation member 107*a* which is integrated with the moving rack 107. The home position of the registration rod 103 is set outside of the maximum width Hmax of the sheets P, as discharged onto the sort bins 76 shown in FIG. 8. With this positioning, therefore, the home position sensor S5 detects the home position by shielding its optical path by the actuation member 107*a* of the moving rack 107.

Figure 10:
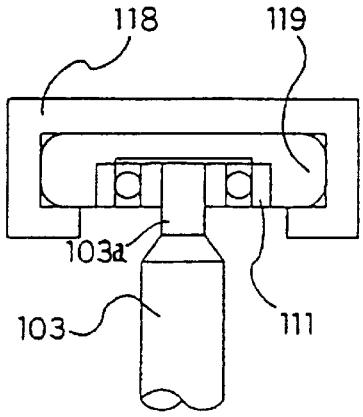
FIG. 10 is a side elevation for explaining a supporting portion of and a moving mechanism for a registration rod 103 composing the sheet registration apparatus 100 of FIG. 9.

On the other hand, the registration guide portion 102 in the sheet registration apparatus 100 will be described in detail with additional reference to FIG. 10.

This registration guide portion 102 supports the upper end of the registration rod 103 turnably, when the registration rod 103 turns and moves to the direction A or B in FIG. 9, and functions as a guide for guiding the same in the direction A or B. For these actions, a slide member 119 is movably fitted in the groove of a guide member 118 which is fixed on the ceiling plate of the support member 77, and the stem 103*a* of the registration rod 103 is turnably supported in the other thrust bearing 111 which is buried in the slide member 119. Here, a portion of the guide member 118 is omitted from FIG. 9. Moreover, the guide member 118 and the guide 106 on the side of the drive plate 105 are arranged in parallel with each other so that they are naturally in a parallel relation to the openings 95 of the sort bins 76.

In the construction thus far described, the sheets P stacked on the sort bins 76 are registered as the registration rod 103 is shifted into the widthwise direction perpendicular to the delivery direction of the sheets P by the registering operation. When this registering operation starts, more specifically, the registration rod 103 is shifted into the direction A, as shown in FIG. 8, and turned to the direction F by the actions of the registration drive portion 101 and the registration guide portion 102. As a result, the sheets P are moved while being regulated at their one-side end edges in the direction of the regulation face 104*a* of the one regulation plate 104 and are further moved toward the reference wall 97 on the side perpendicular to the regulation face 104*a*. As a result, the sheets P are moved into the reference position directions perpendicular to each other by the common actions, i.e., one registering action so that they are accurately registered at their one-side end edges (or the widthwise edges of the sheets P) and at their trailing edges.

Here will be described the post-treatment of the sheets which have been registered, as described above. The post-treatment in this embodiment is exemplified by the stapling operation. A structure of the stapling unit for this stapling treatment will be described with reference to FIG. 11.

With first reference to FIG. 8, the stapling unit 120 for stapling the sheets P which have been discharged to the sort bins 76 and registered by the sheet registration apparatus 100 is made turnable on a stapler turning shaft 121. Especially, the stapling unit 120 is turned on the turning shaft 121 but is relieved at the aforementioned times of discharging and registering the sheets P to the position, as indicated by solid lines, which is retracted from the stapling position. At the stapling time, moreover, the stapling unit 120 is moved to the stapling position, as indicated by single-dotted lines in FIG. 11.

Therefore, the sort bins 76 are provided with the staple relief 99 for stapling the bundle of sheets P, which are registered when the stapling unit 120 is turned to the stapling position shown in FIGS. 1 and 8, on the sheet faces of the sort bins 76.

A structure for turning the stapling unit 120 will be described with reference to FIG. 11. The stapling unit 120 is so held on a stapler turning frame 122 that it can turn on the stapler rotary shaft 121 which extends the stapler turning frame 122 vertically. This turning shaft 121 is rotatably hold on the side of the frame 78 of the staple sorter 7.

Figure 11:
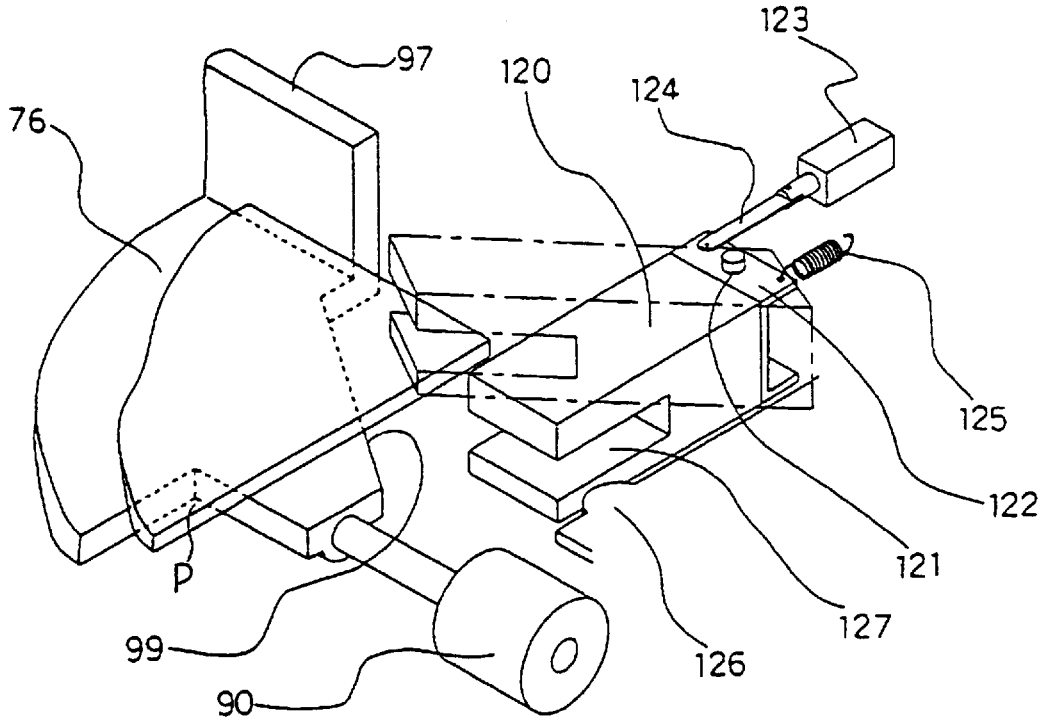
FIG. 11 is a perspective view showing a structure of a stapling device 120 for post-treating or stapling the sheets P registered on the sort bin 76.

To the stapler turning frame 122, there is connected through an arm 124 a solenoid 123 for attracting the stapling unit 120 in a direction to turn it to the stapling position (as indicated by single-dotted lines in FIG. 11). A return spring 125 is attached to the stapler turning frame 122 on the side opposed to the solenoid 124 across the stapler turning shaft 121. The other end of the return spring 125 and the solenoid 123 are retained and fixed by the frame 78 of the staple sorter 7. When the solenoid 123 is not energized, therefore, the stapling unit 120 is elastically biased to the relief position (as indicated by solid lines in FIG. 11) through its stapler turning frame 122 on the stapler turning shaft 121.

When the solenoid 123 is energized, the stapling unit 120 is turned to the stapling position, as indicated by the single-dotted lines, through the arm 124 against the biasing force of the return spring 125. When the energization of the solenoid 123 is interrupted, moreover, the stapling unit 120 is returned to the stand-by position, as indicated by the solid lines, by the biasing force (or the elastic force) of the return spring 125 until it is stopped in abutment against a stopper (or a regulation projection) 126. This topper 126 is formed on the aforementioned frame 78.

The stapling unit 120 is set to such a height that when it turns to the stapling position of the staple relief 99 of the sort bin 76, its staple opening 127 may be passed therethrough by the corners of the sheets P registered on the sheet faces.

As a result, when the bundle of sheets P on the sort bin 76 is registered in abutment against the regulating face 104*a* and the reference wall 97 by the sheet registration apparatus 100, the stapling unit 120 moves from the relief position to the stapling position to perform the stapling operation. When one staple is finished, the stapling unit 120 is once moved to the relief position, and the next sort bin 76 is raised or lowered by one step so that the sheets P stacked on the sort bin 76 are registered again by the sheet registration apparatus 100. After this, the stapling unit 120 is turned to the stapling position to perform the stapling operation.

For this stapling treatment, the bundle of sheets P on the sort bin 76 are registered not only on one side but also on the perpendicular side by the sheet registration apparatus 100 so that the stapling treatment is made accurate while being stabilized.

Control Operations in Sheet Registration Device 100

Here will be described the control operations of the discharge, the preferred registration and the stapling operation of the sheets P at the time when the sheets P imaged by the image forming apparatus such as the copying machine 1 shown in FIG. 3 are fed to the sheet post-treating apparatus or the staple sorter 7. The control will be described at first with reference to the flow chart shown in FIG. 12.

The individual keys on the (not-shown) control panel, as disposed on the body of the copying machine 1, are operated at will to input not only the copying conditions such as the magnification or the density but also the post-treatment conditions of the staple sorter 7. When the copying operation start key is operated after the end of the inputting operations, the sheets P having the images formed by the copying machine 1 are delivered to the side of the staple sorter 7. At this time, the job signals such as the stapling conditions inputted as above are fed to the control unit on the side of the staple sorter 7.

Figure 12:
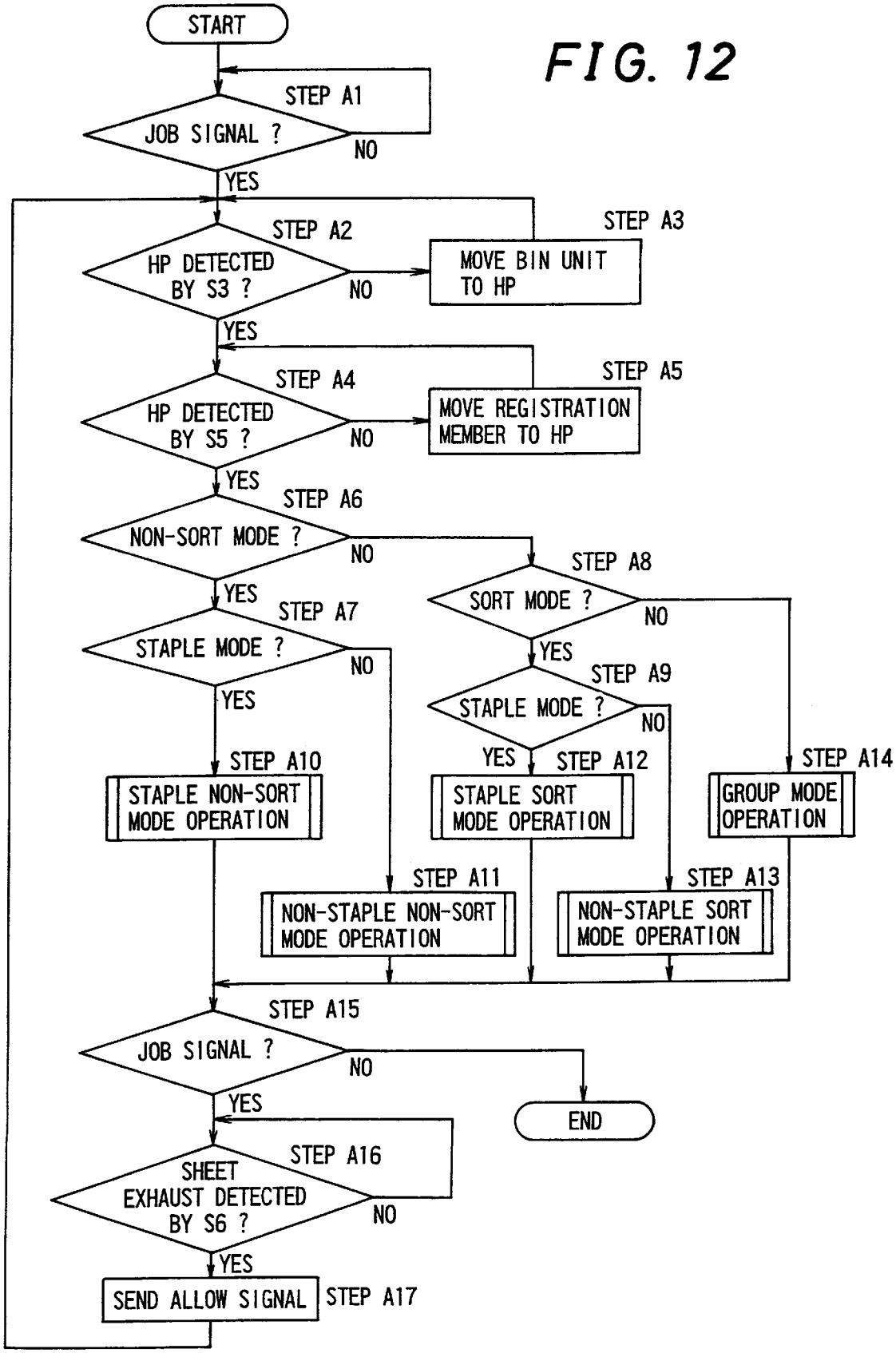
FIG. 12 is a control flow chart showing a control procedure of the individual modes by the staple sorter 7 having the stapling function.

As shown in FIG. 12, therefore, the staple sorter 7 awaits the job signal (at STEP A1). It is detected by the home position sensor S3 of the support member 77 (at STEP A2) whether or not the support member 77 is at the home position (as abbreviated by "HP" in FIG. 12). In the case the support member 77 is at the home position, the routine advances to a next STEP. In the case the support member 77 is not at the home position, the support member 77 is moved to the home position (at STEP A3).

Here, at the home position of the support member 77, the uppermost sort bin 76-1 is either at a position to confront the sort discharge rollers 75 or at a lower position.

Next, it is detected by the registration home position sensor S5 (at STEP A4) whether or not the registration rod 103 of the sheet registration apparatus 100 is at the home position (as abbreviated by "HP" in FIG. 12). In the case the registration rod 103 is at the home position, the routine advances to a next STEP. Otherwise, the treatment to move the registration rod 103 to the home position is continuously executed (at STEP A5).

It is then decided (at STEP A6) from the signal sent together with the job signal and concerning the post-treatment mode whether or not the non-sort mode is set. In the case the non-sort mode is set, it is then decided (at STEP A7) whether or not the staple mode is set. Otherwise, it is decided (at STEP A8) whether or not the sort mode is set. In the case the sort mode is set, it is decided (at STEP A9) whether or not the staple mode is set. In the case not in the sort mode, the routine advances to a next STEP.

Thus, any of the staple non-sort mode, the non-staple non-sort mode, the staple sort mode, the non-staple sort mode and the group mode is decided, and the controls of these modes are executed, as will be described hereinafter (at STEPs A10 to A14).

Here, in the group mode, a set number of sheets having images formed to correspond to the same page of the document are accommodated in the common sort bin. In the sort mode, such a number of sheets having images formed to correspond to the individual pages of the document as equalized to the number of document are accommodated in the common sort bin.

It is then confirmed (at STEP A15) whether or not the job signal is. In the presence of the job signal, the routine advances to a next STEP, at which it is awaited (at STEP A16) that the sheet P to be discharged to the sort bin 76 is detected by a sheet detecting sensor S6 (as shown in FIG. 2). Then, a signal for allowing execution of a next job is returned (at STEP A17) to the body of the copying machine 1. In the absence of the job signal at STEP A15, the routine thus far described is ended.

Although the description is here reversed, the sensor S6, as described with reference to FIG. 6, for detecting the sheet discharge is attached to the support member 77. This sensor S6 is equipped with light emitting and receiving elements between the individual sort bins 76-1 to 76-n for detecting the passage of the trailing ends of the sheets P to be discharged.

Therefore, the individual post-treatment modes of STEPs A10 to A14 will be described in detail with reference to the flow charts of FIGS. 13 to 17.

Control Operations of Staple Non-Sort Mode

First of all, here will be described the staple non-sort mode shown in FIG. 13.

On the side of the staple sorter 7, the gate solenoid is turned on (at STEP B1) to guide the imaged sheets P to the non-sort path 72, and the switch gate 71 is switched to open the non-sort path 72. Then, the drive motor 83 for the support member 77 is energized to move the support member 77 to the non-sort start position (at STEP B2) so that the imaged sheets P are discharged to the uppermost sort bin 76-1 by detecting the turn of the lead cam 87 of the lead cam sensor S4. At this time, the uppermost sort bin 76-1 is moved to the position to confront the non-sort discharge rollers 74, as shown in FIG. 2. As a result, the sheets P, as discharged from the non-sort discharge roller 74, can be sequentially stacked and accommodated on the sort bin 76-1.

When it is confirmed (at STEP B3) that the support member 77 has moved to the non-sort start position, the input of the size determination signal is awaited (at STEP B4), and the registration size of the sheets P to be registered at a next STEP and a stand-by position h1 for each size of the registration rod 103 are determined (at STEP B5). As a result, the registration rod 103 is moved to the stand-by position h1 for each size (at STEP B6). Thus, the registration rod 103 is held to standby the position corresponding to the size of the sheets to be registered, so that the registration can be shortened more efficiently and effectively, as will be described hereinafter.

Next, the sheet number (n) signal from the body of the copying machine 1 is confirmed (at STEP B7), and a sheet number counter CT1 is set to a value 1 (at STEP B8). Then, a discharge signal is awaited (at STEP B9). In the case this discharge signal is present, the registration at the stack time is performed by the registration rod 103 (at STEP B10). The detail of this STEP B10 will be described hereinafter.

At the end of this registration, the value 1 is added to the sheet number counter CT1 (at STEP B11). It is confirmed (at STEP B12) whether or not the value of the sheet number counter CT1 is equal to the set copy number "n". In the case this answer is NO, the routine is returned to just before STEP B9, so that the registration at the stack time and the addition of the value to the sheet number counter CT1 are repeated till the value of the sheet number counter CT1 becomes equal to the copy number "n".

In the case the value of the sheet number counter CT1 becomes equal to the copy number "n", the routine advances to a next STEP, at which the staple signal from the body of the copying machine 1 is awaited (at STEP B13). In the case the staple signal is issued, the routine advances to a next STEP, at which the registration rod 103 is moved to and stopped at the registration position for each size (at STEP B14).

With the registration rod 103 being stopped at the registration position h3 for each size, moreover, the stapling operation is executed (at STEP B15), and the registration rod 103 is moved to the home position (at STEP B16). Thus, the staple non-sort mode is ended.

Here, the registration rod 103 is moved to and stopped at the registration position h3 for each size of the sheets P so that the bundle of the sheets P registered at the stapling treatment can be prevented from being disturbed. At the registration position h3, moreover, the registration rod 103 naturally comes in abutment against the sheets P, and the one-side end edges of the sheets P on the opposite side are in contact with the regulation face 104*a* without any curvature. This registration rod 103 may be retrieved, after the registration of the sheets P, to the stand-by position without being stopped at the registration position h3.

In the staple non-sort mode, by the controls thus far described, the sheets P, as discharged to the uppermost sort bin 76-1, are reliably registered so that they are stapled at last.

Control Operations of Non-Staple Non-Sort Mode

The control operations of the non-staple non-sort mode will be described in detail with reference to the flow chart of FIG. 14.

When this treatment is to be performed by setting the non-staple non-sort mode in FIG. 14, there are executed the same treatments as those of STEPs B1 to B12 and STEP B16 of the control flow chart of the staple non-sort mode, as described with reference to FIG. 13.

Figure 14:
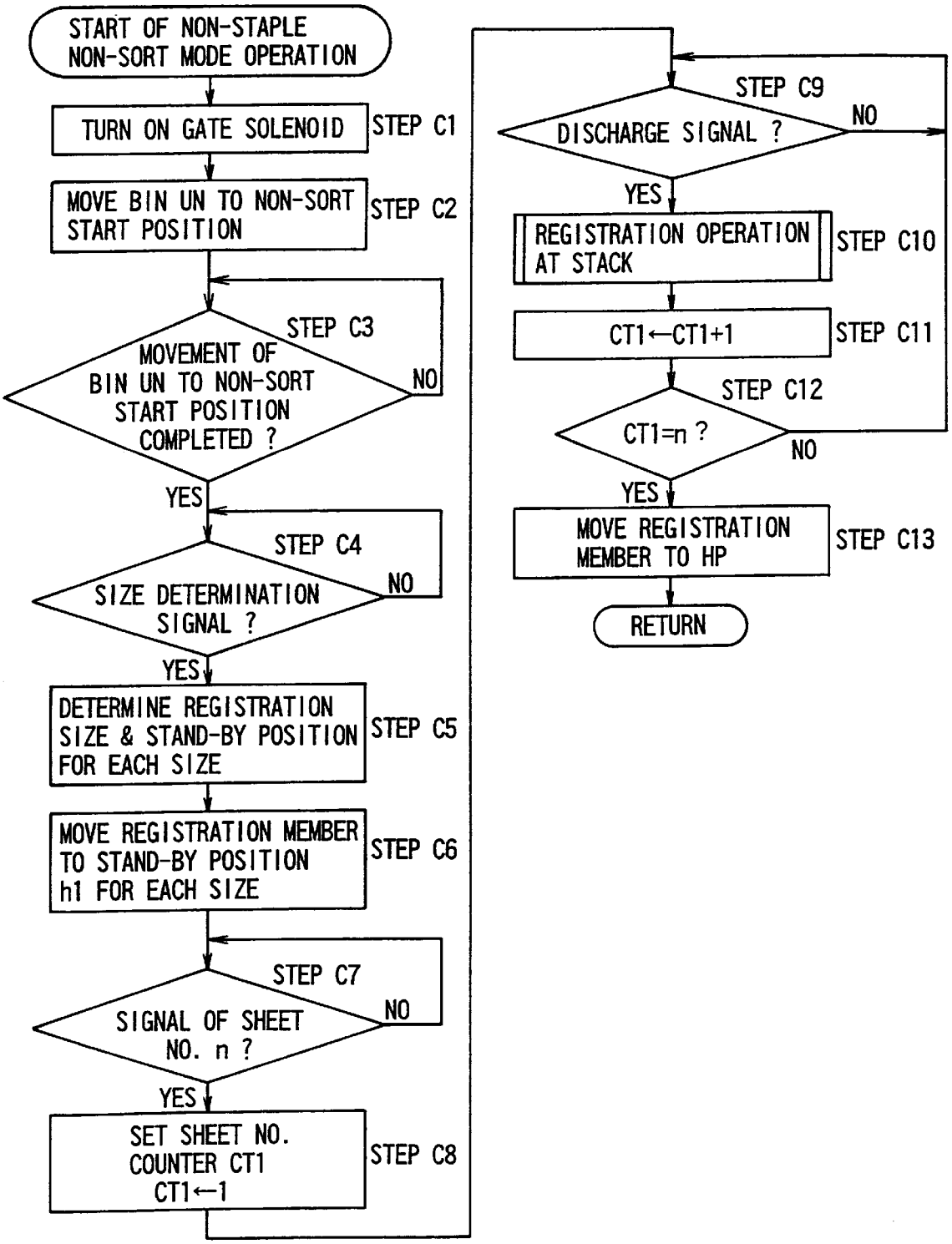
FIG. 14 is a control flow chart showing a sheet registering procedure including the sheet sort control when a non-staple non-sort mode of FIG. 12 is set.

Therefore, the description of the treatments of STEPs C1 to C12 of FIG. 14 will be omitted. When the set number of sheets P are wholly discharged to the sort bin 76-1 and registered, the return of the registration rod 103 to the home position, as at STEP B16, is executed at STEP C13. The treatment routine of FIG. 14 is completed by ending the treatment.

In this non-staple non-sort mode, the registration rod 103 is activated to enhance the registration of the stacked sheets. The sheet registration (at STEP C10) is performed each time one sheet P is discharged but may be performed after the last sheet P is discharged. Moreover, the STEP of registering a small number of sheets may be eliminated, or the registration itself in this mode may be omitted.

Control Operations of Staple Sort Mode

The control operations in the staple sort mode will be described with reference to the flow chart shown in FIG. 15.

Figure 13:
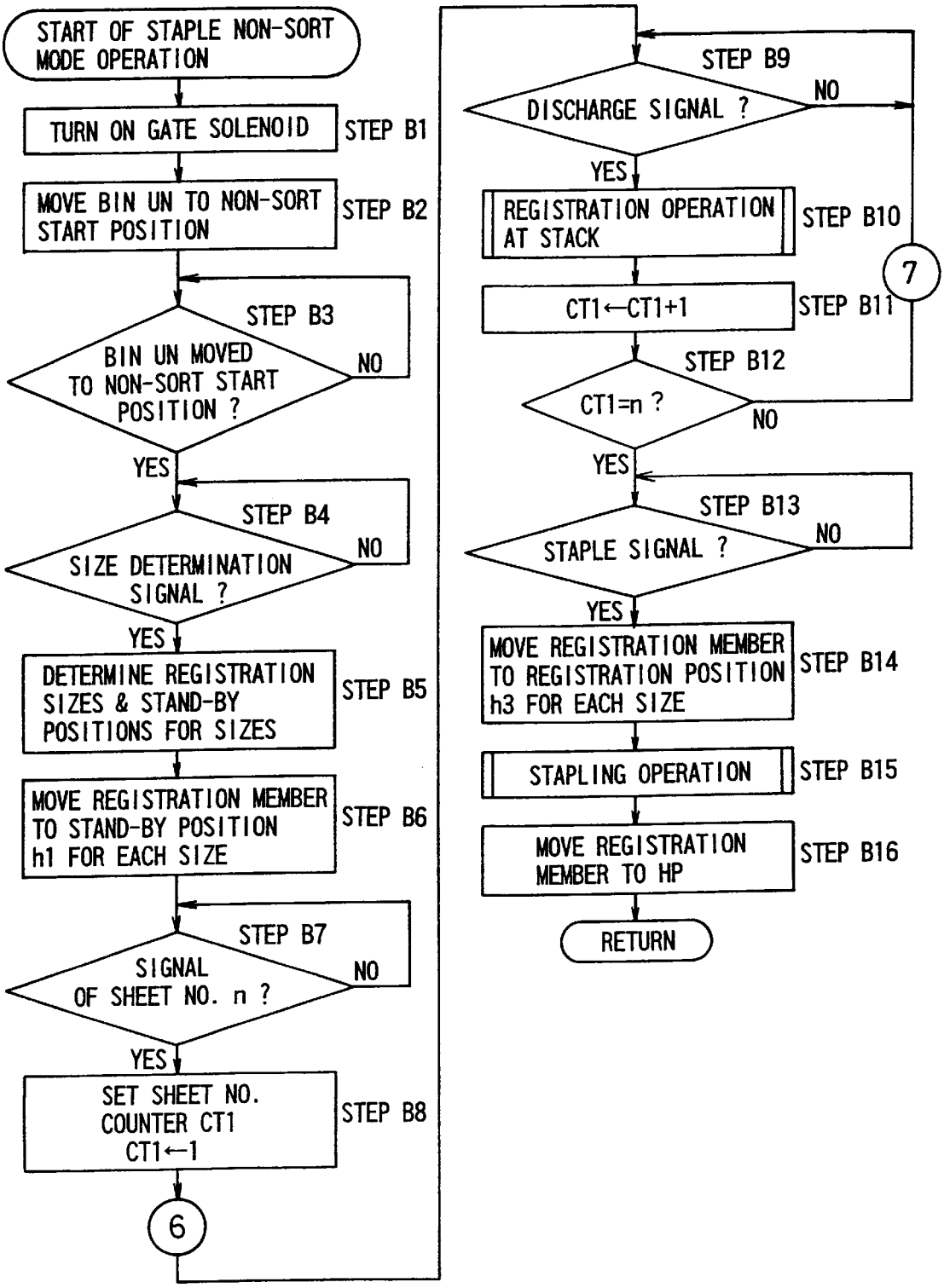
FIG. 13 is a control flow chart showing a control procedure of the sheet registering and stapling operations when a staple non-sort mode of FIG. 12 is set.
Figures 15, 15A:
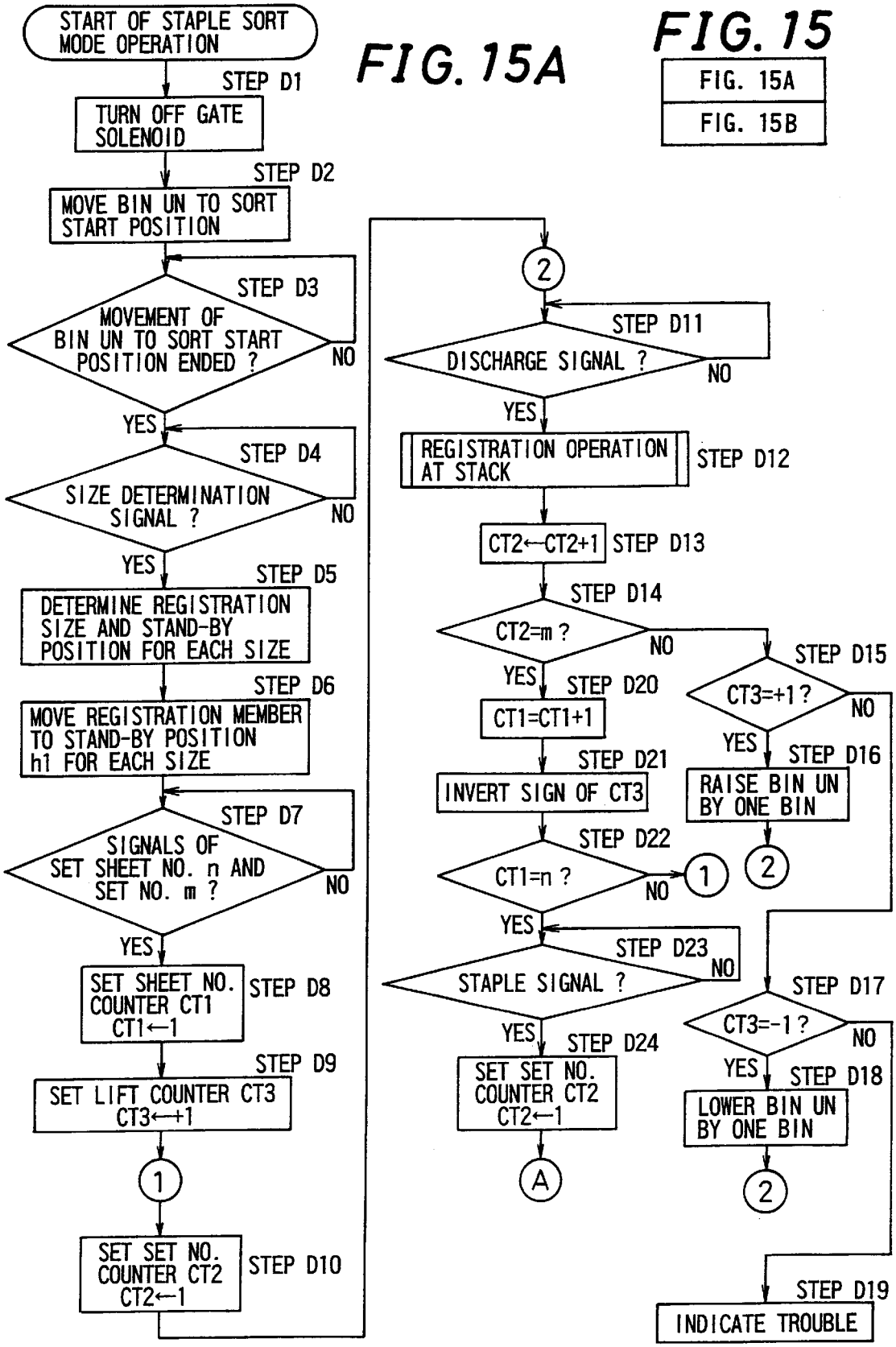
FIG. 15 is a control flow chart showing a control procedure of the sheet registering and stapling operations including the sheet sort control when a staple sort mode of FIG. 12 is set.
Figure 15B:
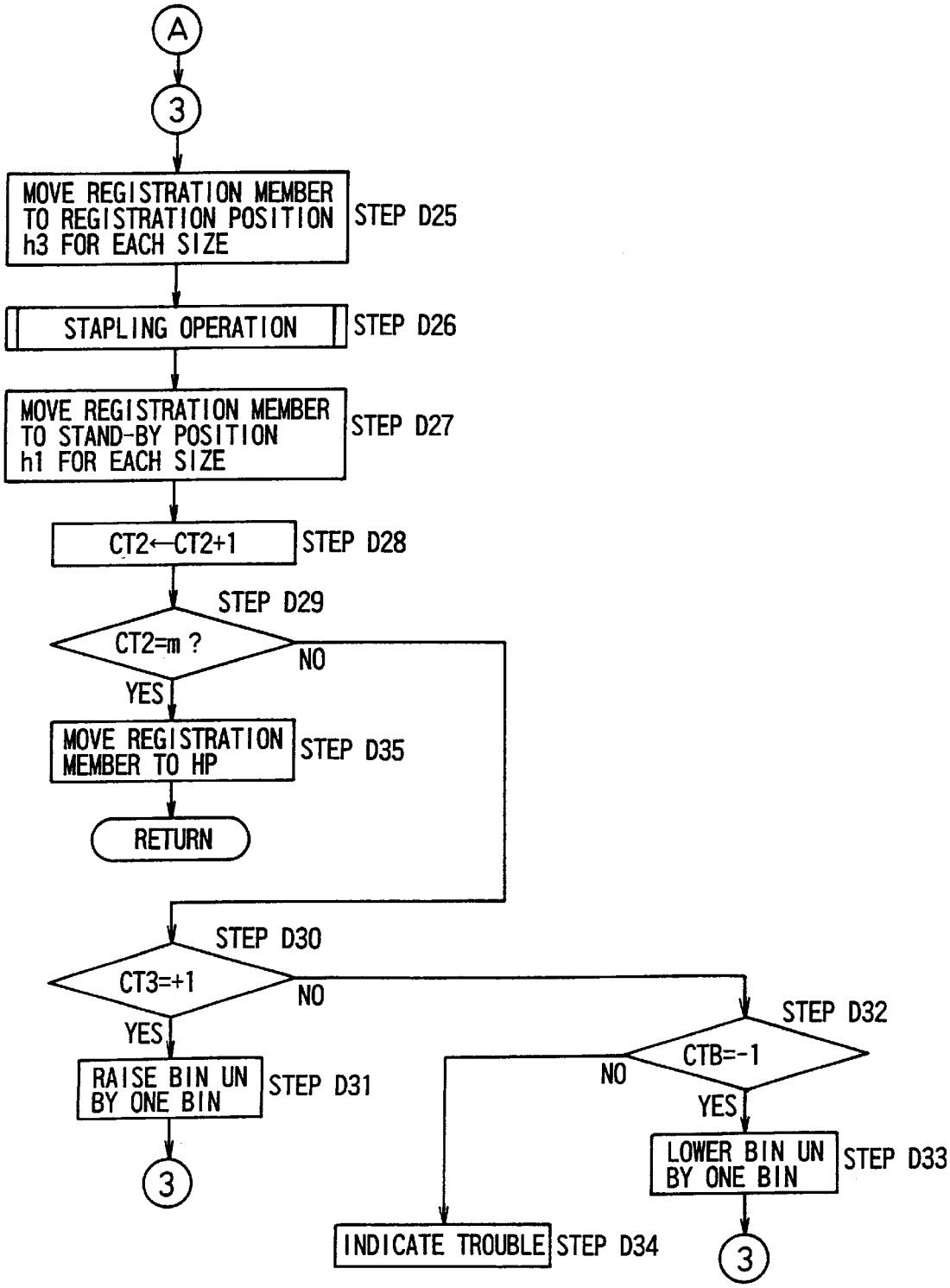

In FIG. 15, there are performed at STEPs D1 to D6 the same treatments such as the aforementioned ones of the staple non-sort mode or the like of FIGS. 13 and 14, excepting those of STEPs D2 and D3.

At STEPs D2 and D3, therefore, it is detected whether or not the support member (i.e., the unit of the sort bin) 77 is at the sort start position, and the support member 77 is moved to the sort start position. As a result, the uppermost sort bin 76-1 is positioned to confront the sort discharge rollers 75 and is caused to stand by so that it can accommodate the sheets P discharged from the sort discharge rollers 75.

At STEP D7, moreover, the signals of the number "n" of one set corresponding to the document number and the copy number "m" of each document are awaited so that the sheet number counter CT1 is set to the value 1 (at STEP D8) whereas a lift counter CT3 is set to the value +1 (at STEP D9).

Subsequently, a set number counter CT2 is set to the value 1 (at STEP D10), and the discharge signal from the sensor S6 is awaited (at STEP D11). In the presence of the discharge signal, the stack registration is performed (at STEP D12). Moreover, the value 1 is added to the set number counter CT2 (at STEP D13), and it is confirmed (at STEP D14) whether or not the value of the set number counter CT2 is equal to "m". In the case the value of the set number counter CT2 is not equal to "m", it is confirmed (at STEP D15) whether or not the value of the lift counter CT3 is at +1.

In the case the value of the lift counter CT3 is at +1, the support member (or the sort bin unit) 77 is raised by one bin (at STEP D16), and the routine is jumped to just before the STEP D11. In the case the value of the lift counter CT3 is not at +1, it is confirmed (at STEP D17) whether or not the value of the lift counter CT3 is at −1. In the case the lift counter CT3 is at −1, the support member 77 is lowered by one bin (at STEP D18), and the routine is jumped like above to just before STEPD11. In the case the lift counter CT3 is not at −1, a trouble is decided and indicated (at STEP D19). In the case the value of the set number counter CT2 is equal to at "m" at STEP D14, the value 1 is added to the sheet number counter CT1 (at STEP D20), and the plus and minus signs of the lift counter CT3 are inverted (at STEP D21). It is confirmed (at STEP D22) whether or not the value of the sheet number counter CT1 is equal to "n". In the case this answer is NO, the routine is jumped to just before STEP D10.

As described above, in the procedure wherein the m sets for n sheets of document are copied by the copying machine 1 so that the imaged sheets P are sequentially discharged to the staple sorter 7, the sort bins 76-1 to 76-m corresponding to the copy number of the m sets are selected so that the n sheets P corresponding to the copy number are sequentially sorted and discharged. By this sorting operation, the sheet registration by STEP D12 is executed each time the sheets P are discharged to the individual sort bins 76, so that the stacked sheets P are registered.

Moreover, the treatments are thus sequentially executed, and the stapling process is executed, as will be described hereinafter, in the case the value of the sheet number counter CT1 at STEP D22 is equal to "n". Specifically, the staple signal is awaited (at STEP D23), and the set number counter CT2 is set to the value 1 (at STEP D24) when the staple signal is sent. Next, the registration rod (or the registration member) 103 is moved to the registration position for each size (at STEP D25), and the stapling operation is executed (at STEP D26) with the registration rod 103 being stopped at the registration position for each size.

When the stapling operation of the n sheets P, which are discharged to and stacked on one sort bin such as the uppermost sort bin 76-1 or 76-m corresponding to the set number m, is ended, the registration rod 103 is moved to the stand-by position h1 for each size (at STEP D27). Moreover, the value 1 is added to the set number counter CT2 (at STEP D28), and it is confirmed (at STEP D29) whether or not the value of the set number counter CT2 is equal to "m". In the case this answer is YES, the registration rod 103 is moved to the home position (at STEP D35), and this treating mode is ended.

In the case the value of the set number counter CT2 is not equal to "m", it is confirmed (at STEP D30) whether or not the value of the lift counter CT3 is at +1. In the case the value of the lift counter CT3 is at +1, the support member 77 is raised by one bin (at STEP D31), and the routine is jumped to just before STEP D25. In the case the value of the lift counter CT3 is not at +1, it is confirmed (at STEP D32) whether or not the value of the lift counter CT3 is at −1. In the case this answer is YES, the support member 77 is lowered by one bin (at STEP D33), and the routine is jumped to just before STEP D25. In the case the value of the lift counter CT3 is not at −1, the trouble is decided and indicated (at STEP D34).

By these controls, in the treatment of the staple sort mode, the bin number, which corresponds to the set number "m" set from the uppermost sort bin 76-1 to the lower sort bin 76-m, is employed to register and accommodate the sheets P, which are copied in the order of documents, on the individual bins 76, and are then stapled.

Control Operations of Non-Staple Sort Mode and Group Mode

Figure 17:
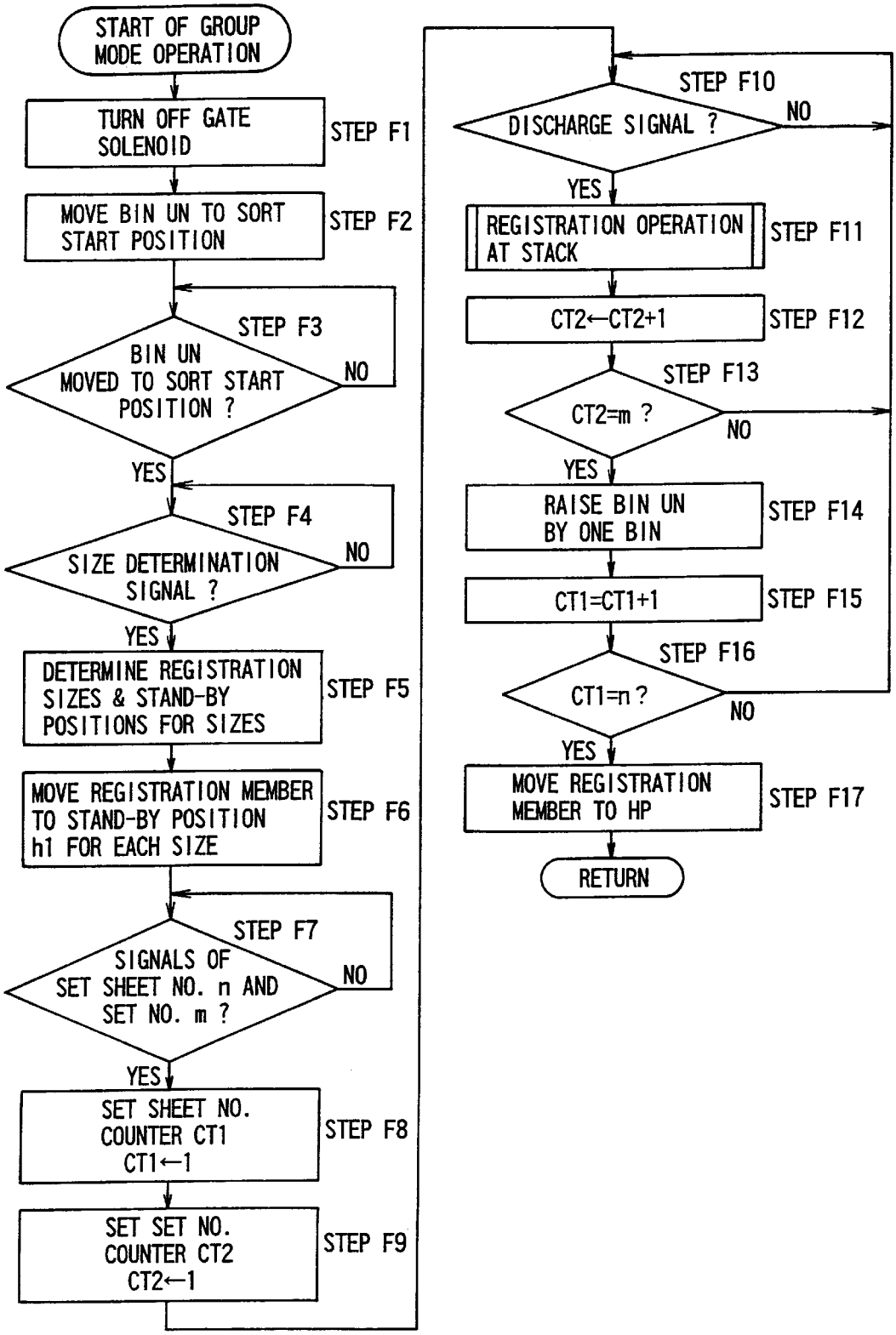
FIG. 17 is a control flow chart showing a control procedure of the sheet registering operation including the discharge of the sheets of the individual groups to the sort bin when the group mode of FIG. 12 is set.

Subsequently, the control operations of the non-staple sort mode or the group mode will be described with reference to the flow charts shown in FIGS. 16 and 17.

In the non-staple sort mode, as shown in FIG. 16, the treatments of STEPs E1 to E22 are identical to those of STEPs D1 to D22 in the flow chart of the staple sort mode, as has been described with reference to FIG. 15.

At STEP E23 after the m sets of copied sheets P corresponding to the n sheets of documents were sorted to the individual sort bins 76-1 to 76-m so that their registration was completed, therefore, the control to move the registration rod 103 to the home position is executed, and this routine is ended.

Since the sorting treatment of the sheet P is thus executed and controlled, in the non-staple sort mode, only the uppermost one of the bins 76-1 to 76-m is used to register and accommodate the sheets P, as copied in the order of document pages, on the individual sort bins 76.

On the other hand, the control operations of the group mode will be described with reference to the flow chart shown in FIG. 17. In this flow chart, the treatments of STEPs F1 to F8 are identical to those of STEPs D1 to D8 of the staple sort mode, as described with reference to FIG. 15.

At STEP F9, the set number counter CT2 is set to the value "1", and the discharge signal is awaited (at STEP F10). In the presence of this discharge signal, the sheets are registered (and stacked) (at STEP F11). Then, the value "1" is added to the set number counter CT2 (at STEP F12), and it is confirmed (at STEP F13) whether or not the value of the set number counter CT2 is equal to the value "m".

In the case the value of the set number counter CT2 is not equal to "m", the routine jumps to just before STEP F10. In the case the value is the set number counter CT2 is equal to "m", the support member (or the sort bin unit) 77 is raised by one bin (at STEP F14), and the value "1" is then added to the sheet number counter CT1 (at STEP F15). It is then confirmed (at STEP F16) whether or not the value of the sheet number counter CT1 is equal to the document sheet number "n".

In the case the value of the sheet number counter CT1 is not equal to the document sheet number "n", the routine jumps to just before STEP F10. In the case the value of the sheet number counter CT1 is equal to the document sheet number "n", the registration rod 103 is moved to the home position (at STEP F17), and this routine is ended.

In the treatments of the group mode thus far described, the uppermost one of the sort bins 76-1 to 76-n is used so that the copied sheets P are registered and accommodated in the sheet number corresponding to the desired set number "m" on the individual sort bins 76.

Staple Control

Figure 18:
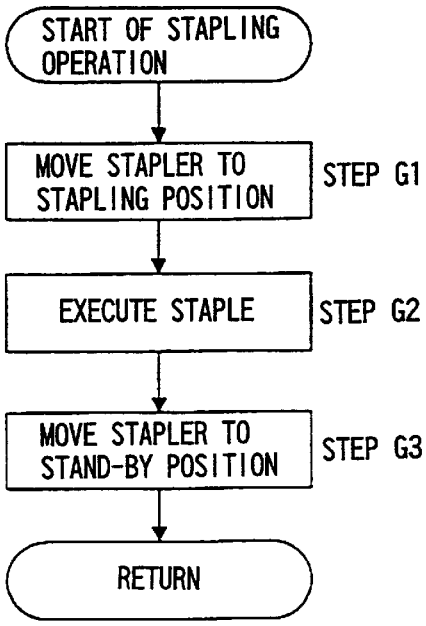
FIG. 18 is a control flow chart showing a control procedure of the stapling operation after the sheets are registered by the staple sorter 7 having the stapling function.

The actions of the staple control will be described with reference to the flow chart shown in FIG. 18. This control routine is the stapling process of STEP B15 shown FIG. 13, for example, or the stapling process of STEP D26 shown in FIG. 15.

First of all, the stapler turning solenoid 123 is turned on to move the stapling unit 120 to the stapling position (at STEP G1). This position is indicated by single-dotted lines in FIG. 11. When the stapling unit 120 is turned to the stapling position, the stapling process is executed (at STEP G2). After this stapling process, the stapler turning solenoid 123 is turned off to move the stapling unit 120 to a stand-by position (at STEP G3), and this routine is ended.

Registration Treatment Control of Sheets

Here will be described in detail the actions to register the sheets which have been discharged to and stacked on the individual sort bins 76. For this detailed description, reference is made to the action describing diagram of FIG. 19 and the control flow chart shown in FIG. 20.

Figure 19:
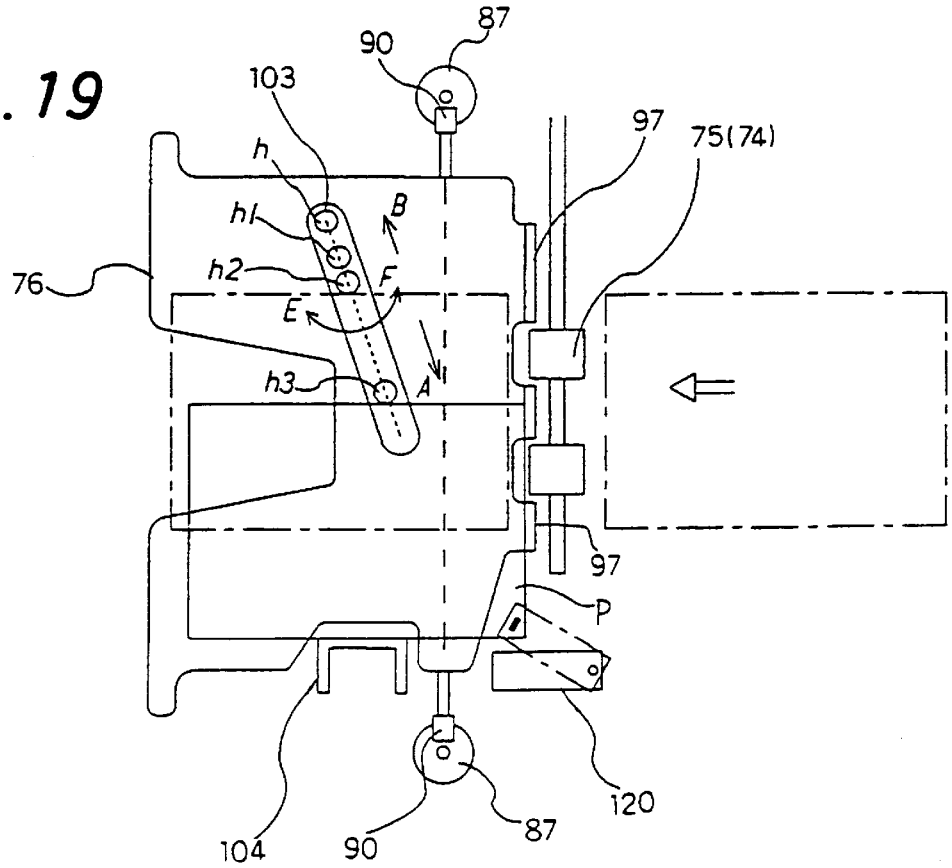
FIG. 19 is a top plan view for explaining the registering operation of the sheets discharged onto the sort bit 76 according to the first embodiment in the sheet registration apparatus 100 of the invention.
Figure 20:
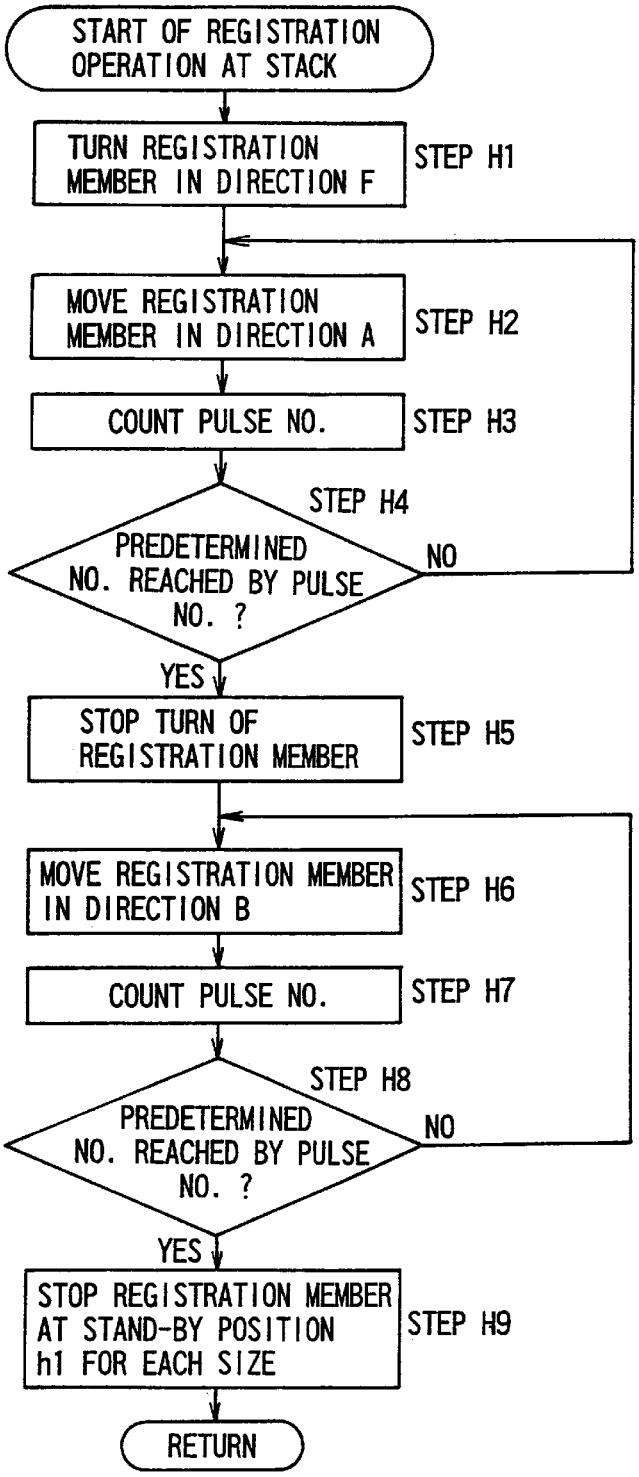
FIG. 20 is a control flow chart showing a sheet registering procedure for the sheet registering operation of FIG. 19.

FIG. 19 is a top plan view showing the actions to move the registration rod 103 when the long sheets P are discharged. On the other hand, FIG. 20 is a control flow chart for efficient and reliable registration treatments to perform the sheet registration of the invention. This control routine, as shown in FIG. 20, is the treatments of the "Registrations at Stack", i.e., the sheet registration treatments of STEPs B10, C10, D12, E12 and F11 in the flow charts of FIGS. 13 to 17.

In the treatments of the individual modes of FIGS. 13 to 17, the registration rod 103 is so reduced in its moving stroke that it may register the sheets P efficiently and promptly in FIG. 19 before the discharge of the sheets onto the sort bins 76. For this reduction, the registration rod 103 is moved from its home position h to the stand-by position h1 (as shown in FIG. 19) for each size by the action of the registration drive motor (as shown in FIG. 9) 115. After the discharge of the sheets P, the registration rod 103 is then moved into the direction A to the registration position h3 for each size to register the sheets P stacked on the sort bins 76.

The controls of the aforementioned registration treatments will be described in detail with reference to the flow chart of FIG. 20 together with the action diagram of FIG. 19. In these treatments, the registration rod 103 is moved to the stand-by position h1 for the sheet registration, as described hereinbefore, and is held in the stand-by state for the sheet registration.

When the routine of the registration is started at the stack, the registration rotary motor 108 or the stepping motor is rotated in the direction D to turn the registration rod 103 to the direction F (at STEP H1). Next, the registration drive motor 115 is rotated in the direction G to move the registration rod 103 into the direction A (at STEP H2). Immediately after the rotation of this registration drive motor 115, the operation to count the number of pulses to be fed to the registration drive motor 115 is started (at STEP H3). Here, the registration rod 103 is moved in advance from the home position h and held at the stand-by position h1, as shown in FIG. 19. The size of the sheets to be sorted is detected by the well-known detector so that the stand-by position h1 is determined according to the detected size. Thus, the registration drive motor 115 is stopped by counting that number of the drive pulses of the motor 115 which corresponds to the stand-by position h1, from the instant when the home position sensor S5 detects the home position h.

Reverting to FIG. 20, it is awaited (at STEP H4) that the counted pulse number reaches a predetermined number necessary for the movement from the stand-by position h1 for each size to the registration position h3 for each size. In the case the predetermined pulse number is counted, therefore, the rotation of the registration rod 103 by the registration rotary motor 108 is stopped (at STEP H5).

On the other hand, the registration drive motor 115 is reversed (to rotate in the direction H) to move the registration rod 103 from the registration position h3 for each size into the direction B (at STEP H6). Next, the counting operation of the pulse number is started (at STEP H7), and it is awaited (at STEP H8) that a predetermined number of pulses necessary for the movement from the registration position h3 for each size to the stand-by position h1 for each size is reached. When the pulse number reaches the predetermined number, the drive of the registration drive motor 115 is stopped (at STEP H9).

While the registration rod 103 is thus moving from the stand-by position h1 for each size to the registration position h3 for each size, it comes into contact at a contact start position h2 with the one-side end edges of the sheets P on the sort bins 76. Since the registration rod 103 is turning at this time, the sheets P in contact are brought toward the reference wall 97 of the sort bins 76 or the registration reference on the discharge side so that they are registered. As compared with the case in which the sheets P discharged from the non-sort discharge rollers or the sort discharge rollers 75 onto the sort bins 76 are registered by the simple movement of the registration rod 103 into the direction A while they are being moved toward the reference wall 97 by their own weights due to the slope of the sort bins 76 themselves, therefore, the sheets can be more accurately registered by the reference wall 97 of the sort bins 76 or the registration reference in the discharge direction and by the regulation face 104*a* of the regulation plate 104 or the registration reference in the direction perpendicular to the discharge direction, so that the sheets P can be arranged without any shift.

When the registration rod 103 comes to the registration position h3 for each size, moreover, the opposite side opposed to the side, against which the registration rod 103 is in abutment, abuts against the regulation face 104*a* of the registration plate 104. Here, the stand-by position h1 for each size, the registration position h3 for each size and the contact start position h2 are temporarily changed according to the length, as taken perpendicular to the transport direction, of the sheets P, i.e., the size of the sheets P.

Although there has been described in detail the case in which the sheet registration apparatus 100 of the invention is applied to the staple sorter 7, this applied of the sheet registration apparatus 100 should not be limited to the staple sorter 7. For example, the sheet registration apparatus 100 can be applied to the portion on which various sheets are stacked, such as the case in which the imaged sheets P are discharged to the two-side tray 66 and registered for the re-feed or the case in which the document returned onto the document bed is to be registered in a circulation type automatic document transporting deice.

Figure 21A:
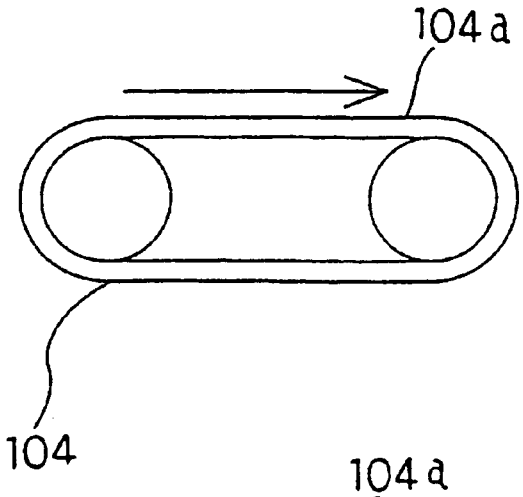
FIGS. 21A and 21B are top plan views showing individual examples of a regulation plate 104, as composing the sheet registration apparatus 100 of the invention, for regulating one end edge of the sheet.
Figure 21B:
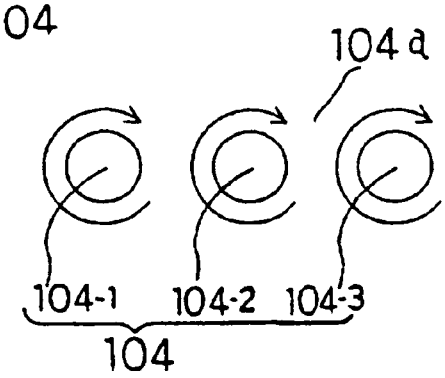

In this case, moreover, the sheets are moved toward the immovable regulation plate 104 which is directed at a right angle with respect to the discharge direction confronting the registration rod 103. As shown in FIG. 21A or 21B, on the contrary, the regulation plate 104 can be formed into a belt structure, in which it runs toward the reference wall 97 in the discharge direction, or the regulation plate 104 can be constructed into a plurality of rod-shaped or circular rotary members 104-1 to 104-3 so that it can transport the sheets P toward the reference wall 97 in the discharge direction. Moreover, the registration rod 103 need not be a rod-shaped rotary member, as in this embodiment, but may be the belt structure, in which it runs toward the reference wall 97 in the discharge direction, as shown in FIG. 21A, or the rod-shaped or cylindrical rotary members or the like, as shown in FIG. 21B. As a result, the abutting sheets P may be transported toward the reference wall 97 in the discharge direction.

Modification of First Embodiment

The sheet registration treatment of the first embodiment thus far described is directed to the case in which the registration rod 103 is separated from the sheets P just after moved to the registration position h3 for each size. If the sheets P are electrostatically charged in this case, it may occur that the sheets P cannot be transported so as to abut against the reference wall 97 or the reference side of the sort bins 76. Therefore, here will be described the modification which is freed from being deteriorated in the registration by the static electricity or the like.

The detailed description will be made with reference to FIGS. 19 and 22 to 25.

Figure 22:
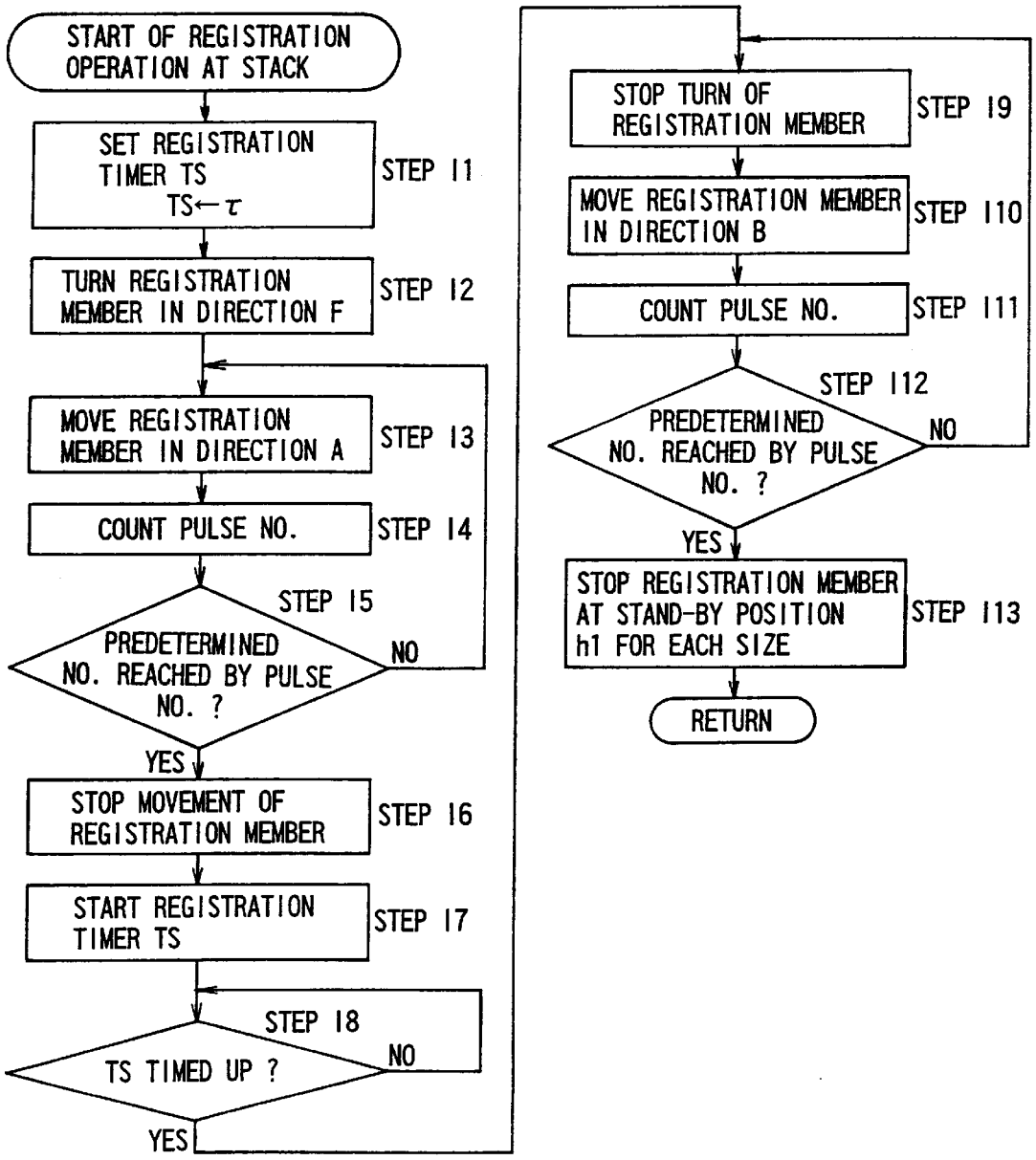
FIG. 22 is a control flow chart showing a sheet registering procedure according another example of the first embodiment of the invention.

FIG. 22 is a flow chart for the sheet registering operation; FIG. 23 is a section showing the registering operation of the registration rod; and FIG. 24 is a top plan view for explaining the action states of forces at the registration time. FIG. 25 is a graph illustrating the characteristics for explaining the relations between the bucking force and the transporting force of the sheets P, and the sheet shift.

First of all, the sheet registering operation of sheets will be described with reference to FIGS. 19 and 22.

When the registration at the stack is started, a registration timer TS is set to $\tau$ (at STEP I1). Next, the operations of STEP I2 to STEP I5 are executed. These treatments of STEPs I2 to I5 are identical to those of STEPs H1 to H4 of the flow of the registration at the stack, as shown in FIG. 20. However, the number of pulses to be counted is the predetermined one or the addition of the pulse number necessary for the movement from the stand-by position h1 for each size and the registration position h3 for each size and the additional pulse number for moving the registration rod 103 into the direction A by a predetermined distance.

When the pulse number reaches the predetermined number, the registration rod 103 reaches the position which is shifted into the direction A by a small distance Δ from the registration position h3 for each size. At this time, the drive motor 115 is stopped (at STEP I6) so as to block any further movement of the registration rod 103. Next, the registration timer TS is started (at STEP I7).

It is awaited (at STEP I8) that the registration timer TS is timed up. By this time-up, the registration rod 103 is continuously turned to the direction F to transport the sheets P toward the reference wall 97 or the trailing end of the discharge direction. At the instant when the registration timer TS is timed up, the registration rotary motor 108 is stopped (at STEP I9) to stop the turn of the registration rod 103, and the registration rod 103 is moved into the direction B (at STEP I10). Immediately after this, the pulse count is started (at STEP I11), and it is awaited (at STEP I12) that the counted number is that for reaching the stand-by position h1 for each size. Then, the registration drive motor 115 is stopped to stop the registration rod 103 at the stand-by position h1 for each size(at STEP I13).

Figure 23A:
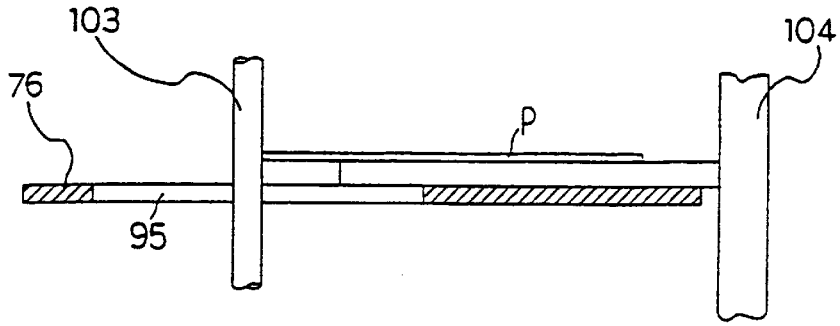
FIGS. 23A and 23B are sections showing the individual states in which the sheets are registered in the control flow chart shown in FIG. 22.
Figure 23B:
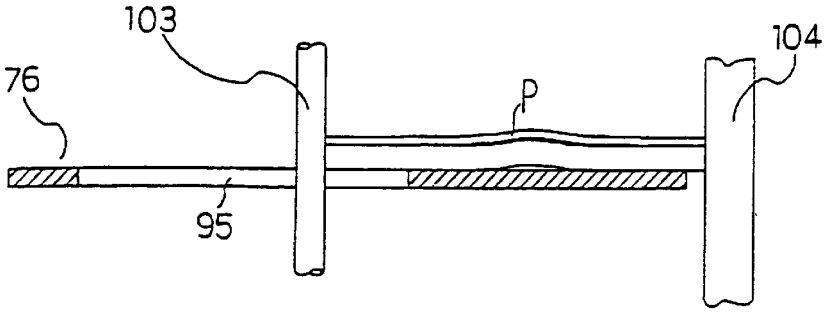
Figure 24:
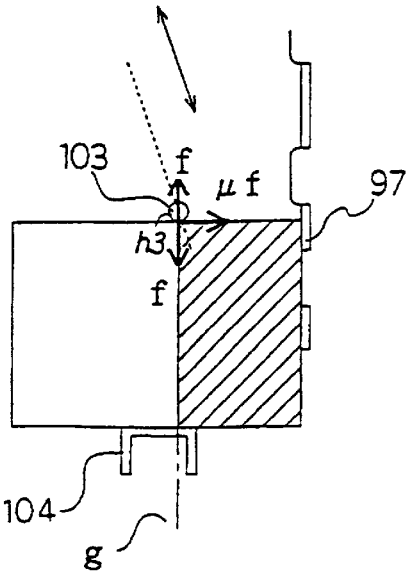
FIG. 24 is a top plan view for explaining the states of the force acting upon the registered sheets shown in FIG. 23.
Figure 25:
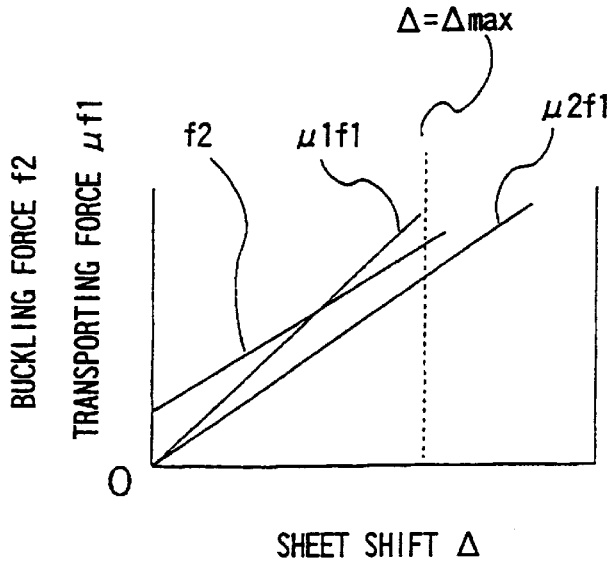
FIG. 25 is a graph illustrating the characteristics for explaining the satisfactory state of the force acting on the sheets of FIG. 24 for keeping the sheet registration in the state where the sheets are not buckled when they are to be registered.

Now, when the registration rod 103 is moved at STEP I7 into the direction A by the small distance Δ (in the state of FIG. 23B) from the registration position h3 for each size thereby to bend the sheets P, as shown in FIGS. 23A and 23B and FIG. 24, the sheets P are clamped between the registration rod 103 and the regulation plate 104. At this time, the transporting force $\mu$f1 to act on the sheets P is expressed by a product of the firmness (i.e., the spring-back force) of the sheets P, as taken in the bent direction by the registration rod 103, and the coefficient $\mu$ of friction between the registration rod 103 and the sheets P. Now, since the transporting force for the sheets P to receive from the registration rod 103 is higher than that for the sheets to receive from the registration rod 103 by the time they reach the registration position h3 for each size, it is convenient to transport the electrostatic sheets P toward the reference wall 97 and to register them.

If, however, the transporting force f1 at this time is higher than a force f2, which is required for such a portion (as hatched in FIG. 24) of the sheets to buckle in the discharge direction as located between a virtual line g extended in parallel with the reference wall 97 to the contact point for the registration rod 103 to contact with the sheets P at the registration position h3 for each size and the reference wall 97, as shown in FIG. 24, the sheets P will buckle to lower their registration at the stack.

In order to improve the registration by avoiding such difficulty, it is advisable to select the friction coefficient between the registration rod 103 and the sheets P such that the transporting force a $\mu$f1 may be lower than the force required for the aforementioned buckling, by metering the force f2 which is required for the buckling when the thinnest sheets allowing the specifications are discharged in the longitudinal direction.

The extent Δ (as will be called the "sheet shift"), by which the registration rod 103 is shifted into the direction A from the registration position h3 for each size, is correlated to the sheet transporting force $\mu$f1 and the force f2 (as will be called the "buckling force") required for buckling the sheets in the discharge direction. This is because the sheets P wave in the direction perpendicular to the direction (i.e., the sheet discharging direction) toward the reference wall 97 so as to establish the shift Δ. Hence, this correlation is illustrated in FIG. 25 by taking the transporting force $\mu$f1 and the buckling force f2 of the sheets on the ordinate and by taking the sheet shift Δ on the abscissa. In FIG. 25, it is sufficient that the buckling force f2 is higher at all times than the transporting force $\mu$f1 of the sheets in the region where the sheet shift Δ is lower than the maximum value Δmax. If, therefore, the transporting force is higher, as indicated by $\mu$1f1, than the buckling force f2 in the region lower than the maximum sheet shift Δmax, the transporting force is lower, as indicated by $\mu$2f1, than the buckling force f2 within the region lower than the Δmax, by changing the friction coefficient $\mu$1 between the registration rod 103 and the sheets P into $\mu$2.

In order to reduce the friction coefficient $\mu$ between the registration rod 103 and the sheets P, the region for the registration rod 103 to contact with the sheets P may be made of plastics or metals. It is also understood that rubber or the like may be employed so as to raise the friction coefficient $\mu$ between the registration rod 103 and the sheets P.

By these controls, therefore, the sheets P can be reliably controlled without their registration being deteriorated by the static electricity.

Another Example of First Embodiment

In the controls of the registration of the sheet thus far described, the sheets P are registered in abutment against the registration rod 103 and therefore may be damaged by the turning registration rod 103. In order to ensure the registration, for example, the registration rod 103 is turned to register the sheets P while bending them so that it contacts with the sheets P for a long time while being turned. During this long contact, the registration rod 103 may damage the sheets P.

Figure 26:
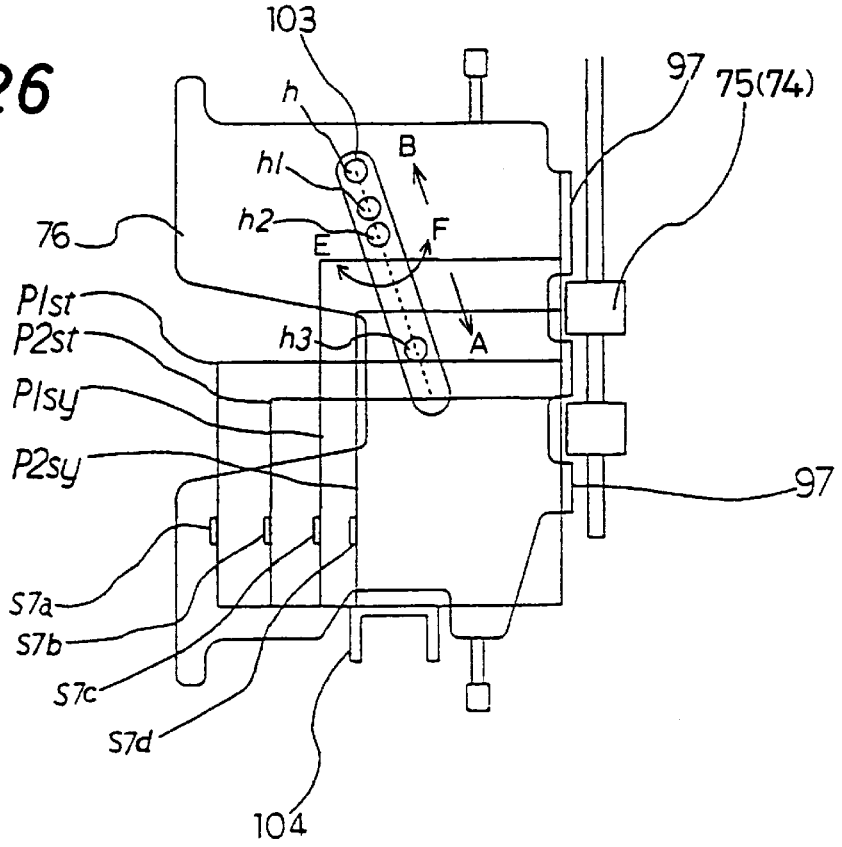
FIG. 26 is a top plan view for explaining the registered state of other sheets in the sheet registration of the first embodiment of the invention.
Figure 27:
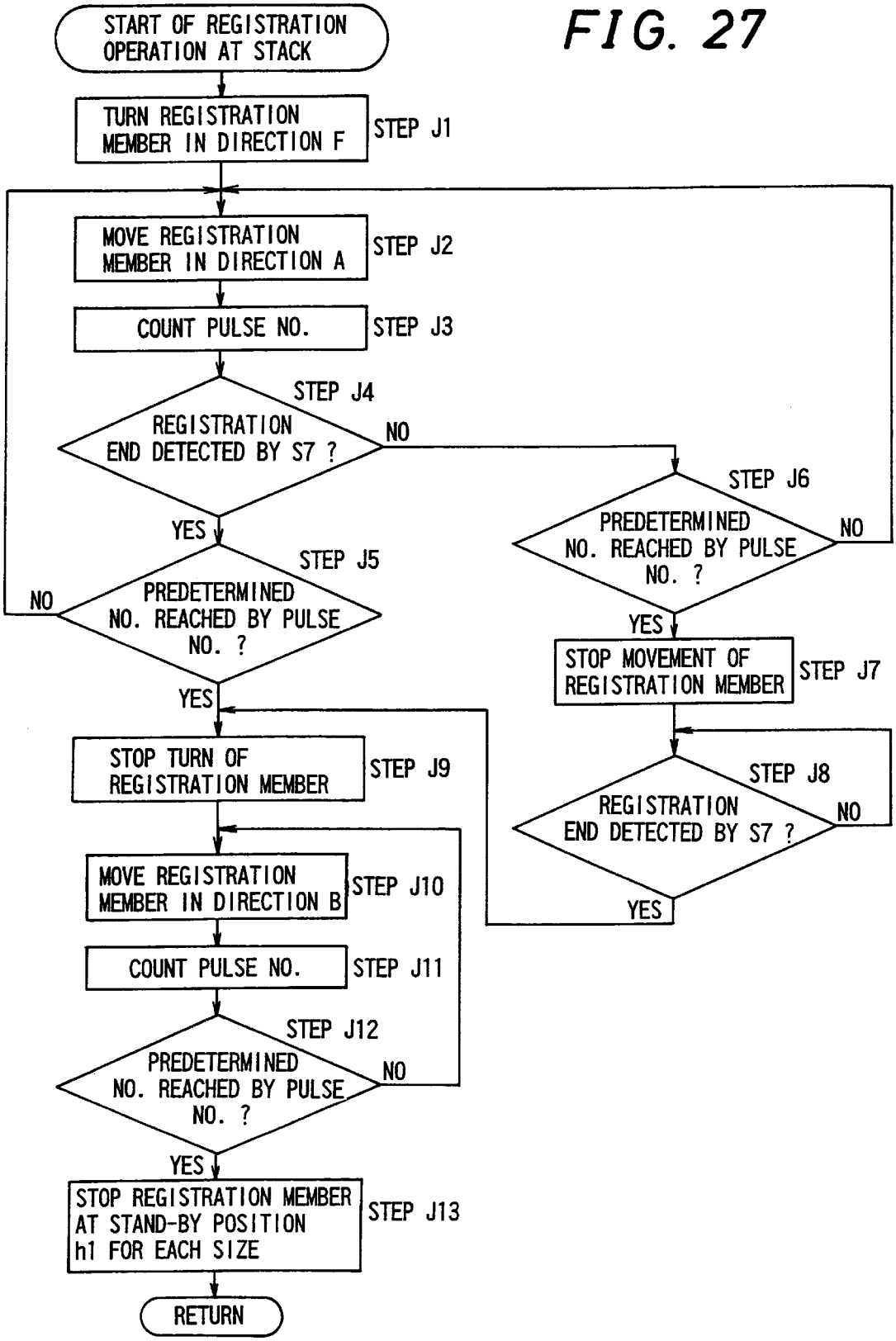
FIG. 27 is a control flow chart showing a sheet registering procedure for the sheet registration of FIG. 26.

Therefore, the controls for the reliable sheet registration without the aforementioned damage will be described with reference to FIGS. 26 and 27. FIG. 26 is a top plan view for explaining the operations, and FIG. 27 is a control flow chart for the reliable sheet registration.

FIG. 26 shows the state in which sheets P1 and P2 of two kinds of sizes discharged longitudinally and transversely are registered. The sheets P, as discharged onto the sort bins 76, are registered by the registration rod 103 separately according to the sizes and the discharge directions of the sheets. In FIG. 26, reference characters P1st and P2st designate the registration regions at the longitudinal discharges of the sheet sizes P1 and P2, and characters P1sy and P2sy designate the registration regions at the transverse discharges of the sheet sizes P1 and P2. At the side portions of the individual registration regions downstream of the discharge direction, there are arranged sensors S7 (S7*a*, S7*b*, S7*c* and S7*d*) for detecting the completions of the registrations, which are so buried in the sort bins 76 as to make no obstruction to the registrations of the sheets P. These sensors S7 detect whether or not the sheets P come into the individual registration regions.

The registration completion sensor S7 is composed of a set of a light emitting portion and a light receiving portion for detecting that the sheets are not registered in the registration region, when the light emitted from the light emitting portion is reflected by the sheets and received by the light receiving portion, and that the sheets are registered in the registration region, when the light is not received by the light receiving portion.

Next, the sheet registration treatment will be described with reference to the flow chart of FIG. 27. First of all, the operations of STEPs J1 to J3 are identical to the operations of STEPs H1 to H3 of the flow chart, as has been described with reference to FIG. 20. It is confirmed (at STEP J4) by the registration completion sensor S7 whether or not the sheets P come into the registration region. In the case of the detection of the registration completion sensor S7, it is confirmed (at STEP J5) whether or not a predetermined number of pulses corresponding to the arrival of the registration rod 103 at the registration position h3 for each size. In the absence of this counting, the routine returns to just before the STEP J2, and the registration rod 103 is moved into the direction A. In the absence of the detection of the registration completion sensor S7 at STEP J4, on the other hand, it is decided (at STEP J6) whether or not a predetermined number of pulses corresponding to the arrival at the registration position h3 for each size is counted. In the absence of this counting, the routine returns to just before STEP J2, and the registration rod 103 is moved into the direction A.

In the case the predetermined pulse number is counted at STEP J6, the movement of the registration rod 103 is stopped (at STEP J7), and it is decided (at STEP J8) whether or not the registration completion sensor S7 detects that the sheets P enters the registration region.

In the case it is detected at STEP J5 that the predetermined pulse number is counted or in the case the registration completion sensor S7 detects the entrance of the sheets P into the registration region at STEP J8, the turn of the registration rod 103 is stopped (at STEP J9). The subsequent operations of STEP J10 to STEP J13 are identical to those of STEP H6 to STEP H9 of FIG. 20, and the registration rod 103 is moved into the direction B and stopped at the registration position h3 for each size.

In the sheet registration treatment thus far described, the registration rod 103 is kept away from abutment against the sheets P and from turning to the direction F after the sheets P comes into the registration region. When the registration rod 103 is to register the sheets, it does not abut against the same portion of the sheets for a long time so that it can less damage the sheets. As a result, the wasteful abutting state between the sheets P and the registration rod 103 can be avoided to reduce the damage of the sheets P by the turning registration rod 103.

Other Examples

In the sheet registration treatments thus far described, the registration rod 103 moves while turning toward the registration plate 104. As a result, the damage of the sheets P by the movement toward the registration plate 104 (or in the direction A) is severer than that to be given to the sheets P by the turning motion. Hence, the damage of the sheets P can be lightened by making the time period for turning the registration rod 103 as short as possible by bending the sheets P. The sheet registration treatment for this less damage will be described with reference to FIG. 28.

Figure 28:
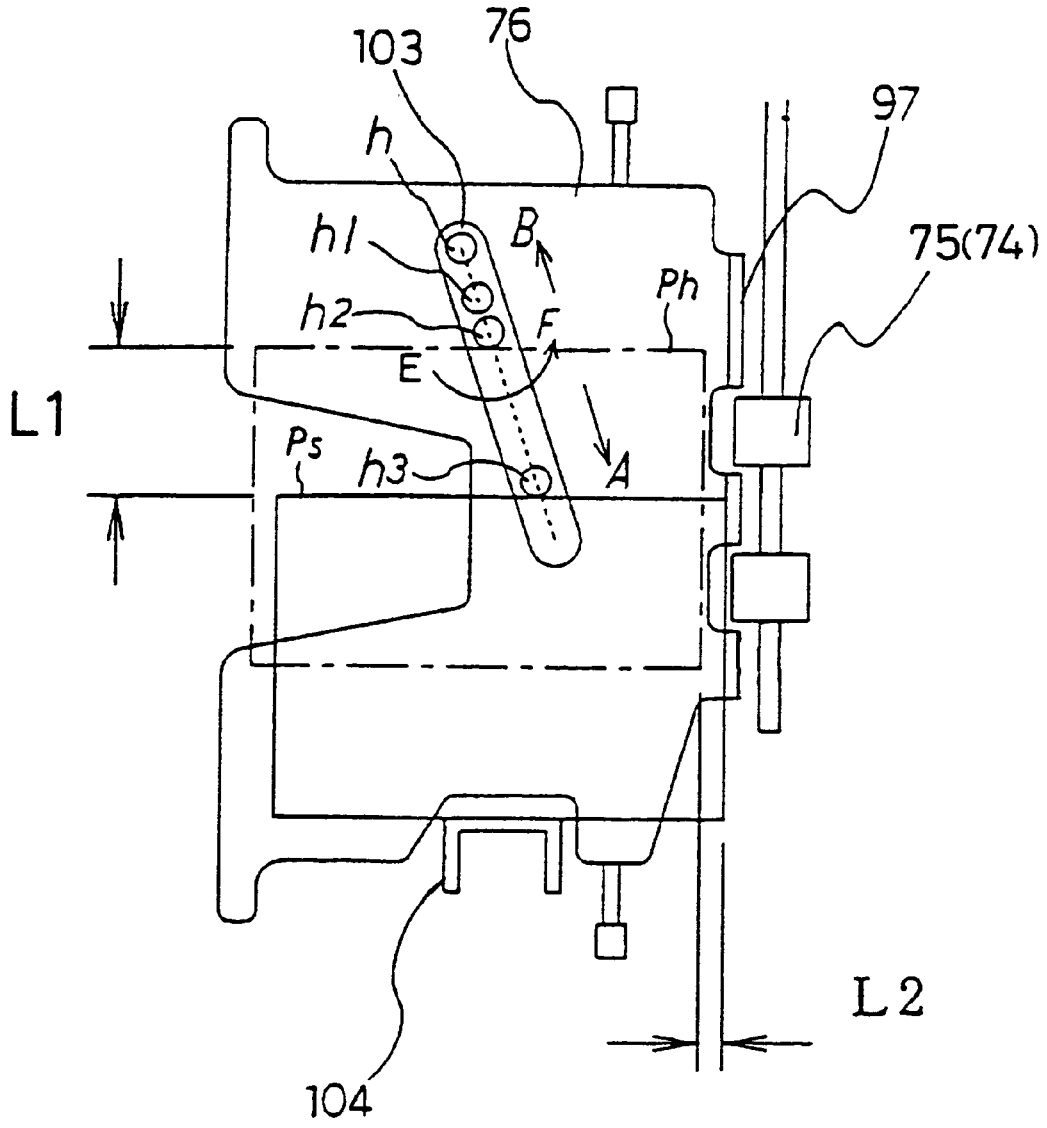
FIG. 28 is a top plan view for explaining the sheet registering operation in another example of the sheet registration of the first embodiment in the sheet registration apparatus 100 of the invention.

In FIG. 28, the moving distance, as taken in the discharge direction when the sheets P discharged from the discharge rollers 75 or 74 are moved from a discharge position Ph to a registration region Ps, is designated by L1, and the moving distance, as taken in the direction perpendicular to the discharge direction, is designated by L2. Moreover, the moving velocity, as taken in the direction perpendicular to the discharge direction while the registration rod 103 moves into the direction A from the contact start position h2 to the registration position h3 of reach size, is designated by Vy, and the transport velocity for the registration rod 103 to turn to the direction F thereby to transport the sheets toward the reference wall 97 is designated by Vt. Then, the regulation of the trailing ends of the discharged sheets Ph by the reference wall 97 occurs earlier to shorten the time period for the registration rod 103 to turn while bending the sheets P in the widthwise direction, if the following relation is satisfied:

$$L1/Vy > L2/Vt.$$

This means the elimination of the damage which might otherwise be given to the sheets P.

By adjusting the rate of pulses to the registration drive motor 115 and the registration rotary motor 108 so as to satisfy the above-specified relation, the magnitudes of the transport velocity Vt and the moving velocity Vy are determined so that the trailing ends of the sheets P can be regulated at first by the turns of the registration rod 103 in the direction F and the sheets P can then be regulated and registered by the registration plate 104.

In FIG. 28, on the other hand, the distance L1 for the movement of the sheets P in the direction A becomes the shorter for the larger size of the sheets P. However, the distance L2 for the registration of the sheets in the discharge direction is unvaried. In order to satisfy the above-specified relation, therefore, it is sufficient to adjust the magnitudes of the transport velocity Vt and the moving velocity Vy. In the case the moving velocity Vy is lowered, however, it becomes necessary to reduce the number of sheets, i.e., the copy sheet number to be transported per unit time from the copying machine 1. These specifications are not preferred.

Moreover, the reduction in number of copies per unit time makes it necessary to make the process rate variable and the control complex.

Therefore, the transport velocity Vt is raised to the higher value as the size for the sheets for forming the images is made the larger. Then, the aforementioned problems can be solved. At the same time, the sheet trailing ends in the transport direction can be regulated at first on the side of the reference wall 97 and then on the side of the registration plate 104 or the other reference at the registration treatment of the discharged sheets P with no relation to the sizes so that the satisfactory registration can be achieved while preventing the damage to the sheets P.

Second Embodiment

In the foregoing first embodiment, there is provided in the stationary state the registration plate 104 which is arranged to confront the registration rod 103 thereby to regulate one-side edges of the sheets P. Another example, in which the sheets P discharged, as shown in FIG. 21, are transported toward the reference wall 97 for regulating the side edges of the sheets P in the direction perpendicular to the registration plate 104, will be described with reference to FIGS. 29 and 30.

Figure 29:
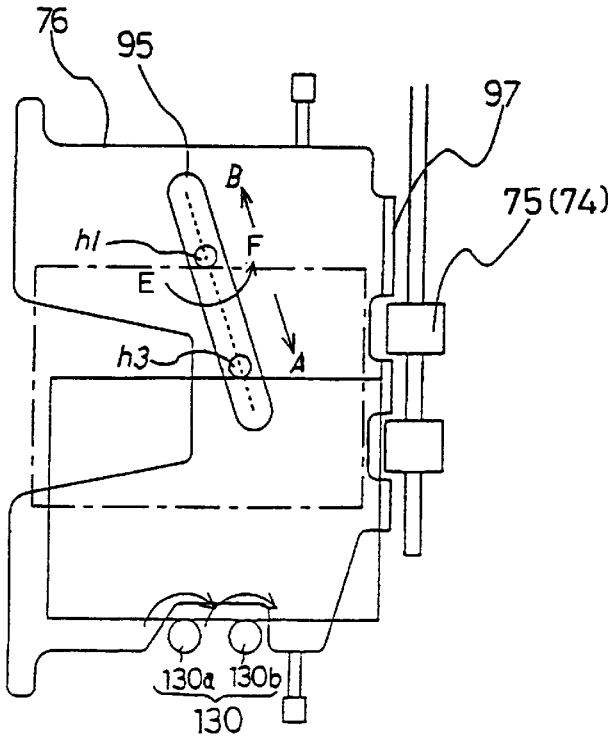
FIG. 29 is a top plan view for explaining the sheet registering operation in a second embodiment of the sheet registering apparatus 100 of the invention.

The reference side regulation member in the direction perpendicular to the sheet discharge direction is exemplified not by the regulation plate 104 in the stationary state, as shown in FIG. 1, but by a transport regulation member 130 for transporting the sheets toward the reference wall 97 in the sheet discharge direction, as shown in FIG. 29.

Figure 30:
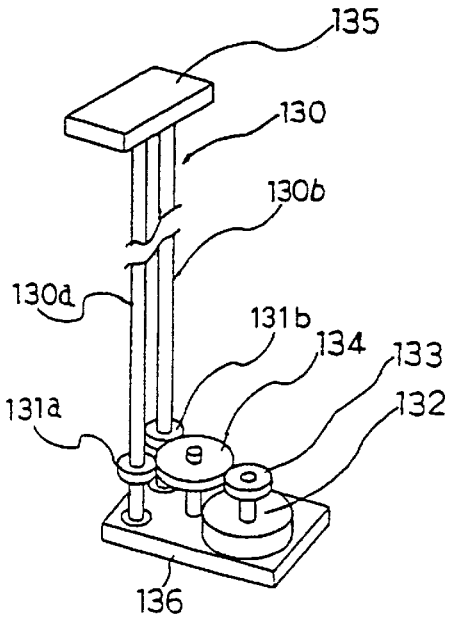
FIG. 30 is a perspective view showing a specific example of a drive unit for rotationally driving regulation rods 130*a* and 130*b* for the sheet registration of FIG. 29.

The transport regulation member 130 is composed of two column-shaped regulation rods 130*a* and 130*b* which are juxtaposed in parallel with the discharge direction of the sheets P, as shown in FIG. 30. On the individual regulation rods 130*a* and 130*b*, there are fixed drive gears 131*a* and 131*b*, which are connected through an intermediate gear 134 meshing with the motor gear 133 of a drive motor 132.

Moreover, the individual regulation rods 130*a* and 130*b* are rotatably supported by thrust bearings, which are mounted in an upper side support member 135, and thrust bearings which are mounted in a lower side support member 136. The intermediate gear 134 is rotatably supported by the lower support member 136, and the drive motor 132 is also held on the lower support member 136. Moreover, the upper and lower support members 135 and 136 are fixed on the support member 77 uniting the sort bins 76, as shown in FIG. 1, or on the side of the frame 78 of the staple sorter 7.

When the drive motor 132 is energized, the two regulation rods 130*a* and 130*b* of the transport regulation member 130 are turned to the direction to transport the sheets P toward the reference wall 97 of the sort bin 76.

The transport regulation member 130 should not be limited to the two regulation rods 130*a* and 130*b* but may be any two or members which are so arranged in parallel that at least one of them may turn in the direction to register the sheets P. Alternatively, the transport regulation member 130 may be constructed into the belt shape to transport the sheets P in the registration direction, as shown in FIG. 21A.

With the construction described above, when the sheets P to be registered are brought by the movement and turn of the registration rod 103 into contact with the side of the transport regulation member 103 constructing the regulation member, the sheets on the sort bin 76 are transported to the side of the reference wall 97 by the turns of the regulation rods 130*a* and 130*b* so that they can be reliably registered. At this time, the registration treatment can be satisfactorily made by the cooperation with the registration rod 103.

Third Embodiment

Next, when the numerous sort bins 76 are stacked in the staple sorter 7, the stapling process may fail to be stable due to the dispersion of the sheet registration by the sort bins 76. Here will be described an embodiment for preventing the instability according to the invention.

Figure 31:
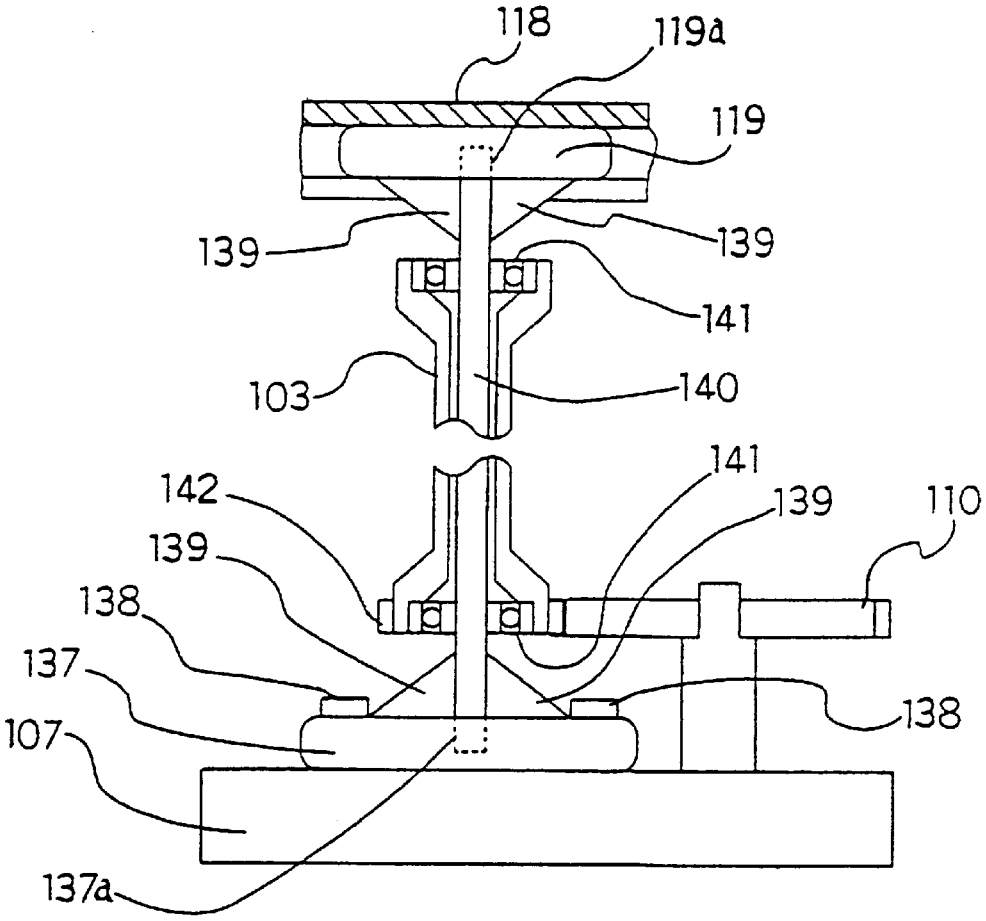
FIG. 31 is a section showing a third embodiment of the sheet registration apparatus 100 of the invention, and shows one example of the construction for holding the registration rod 103 for preventing the dispersion of the sheet registration, as caused by the fall of the registration rod 103 of the sheet registration apparatus 100 in the moving direction for the sheet registration.

FIG. 31 is a section showing an essential portion, as taken from the support structure of the registration rod in a plane along the moving direction of the registration rod. This is different from the support construction of the registration rod 103, as shown in FIG. 9, especially in the construction for supporting the registration rod 103 turnably.

In the lower side of the registration rod 103 and on the moving rack 107, as shown in FIG. 31, there is fixed by fastening members 138 such as bolts a support member 137 which has a recess 137*a*. Moreover, support members 139 are mounted on both sides of the recess 137*a* of the support member 137 in the moving direction (as taken to the right and left of FIG. 31 or in the direction A–B in FIG. 9) of the registration rod 103.

Over the registration rod 103, on the other hand, there is disposed the slide member 119 which is so fitted in the guide member 118 extending in the moving direction of the registration rod 103 as to freely move along the guide member 118. Support members 139 are mounted on both sides of the recess 119*a* in the moving direction (as taken to the right and left of FIG. 31 or in the direction A–B in FIG. 9) of the registration rod 103.

In the two recesses 137*a* and 119*a* formed in the support member 137 and the slide member 119, there are fitted the upper and lower end portions of a support shaft 140 for supporting the registration rod 103. On this support shaft 140, there are so fitted the registration rod 103 as to extend therethrough at its center. The registration rod 103 is rotatably supported at its upper and lower portions through thrust bearings 141. At the lower end portion of the registration rod 103, there is fixed a drive gear 142. This drive gear 142 meshes with the intermediate gear 110 so that the registration rod 103 is turned by the rotation of the registration rotary motor 108, as shown in FIG. 9.

The upper and lower support members 139 support the support shaft 140 on the two sides of the moving direction so that the support shaft 140 may not fall down as its moves to the right and left of FIG. 31. As a result, the registration rod 103 is prevented from falling down in the direction to register the sheets.

In this construction, the support members 139 are disposed on the two sides of the upper and lower end portions of the support shaft 140 in the moving direction of the registration rod 103, and the guide member 118 is elongated in the moving direction of the registration rod 103. When the moving rack 107 moves so that the registration rod 103 registers the sheets P accommodated on the individual sort bins 76, the registration rod 103 can be prevented from being inclined by the reaction received from the sheets, in the direction of the received reaction.

Thus, when the sheet registration apparatus of the invention is applied to the staple sorter 7 having the staple or the punch, it is possible to prevent the dispersion in the registration, as might otherwise be caused for the individual sort bins 76 by the inclination of the registration rod 103. As a result, the positional dispersion of the staple or punch can be reduced to eliminate the deterioration of its quality.

Fourth Embodiment

In the foregoing embodiment, there are separately provided the rotary motor 108 for turning the registration rod 103 for the sheet registration and the drive motor 115 for moving the sheets P toward the regulation plate 104.

This fourth embodiment is constructed such that the turn and movement of the registration rod 103 can be performed by employing one motor, as will be described with reference to FIG. 32.

Figure 32:
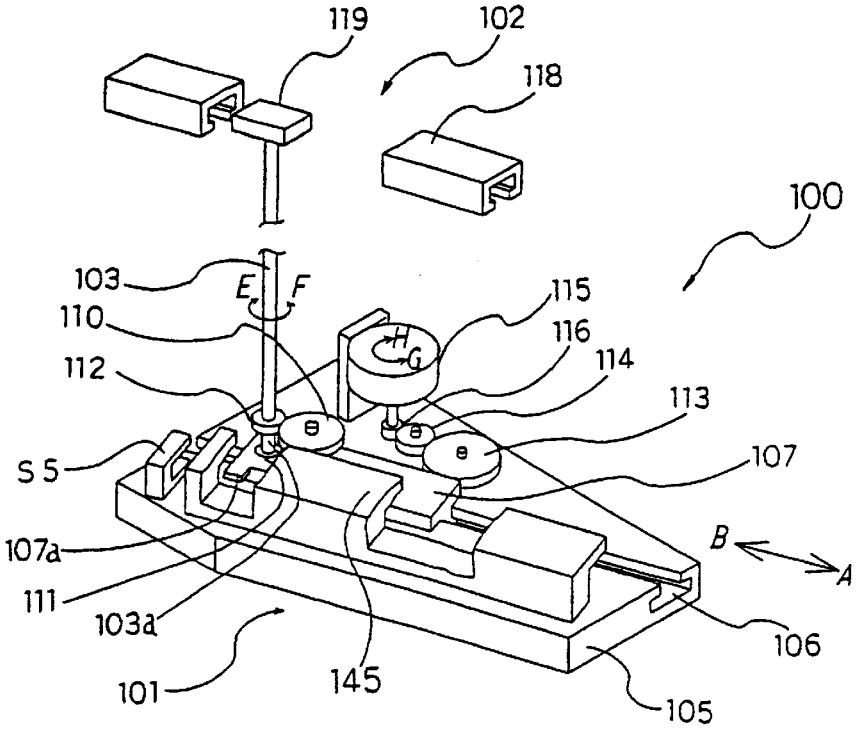
FIG. 32 is a perspective view showing an entire structure of the sheet registration apparatus 100 according to a fourth embodiment of the invention.

In FIG. 32, the same portions as those of FIG. 9 are designated by the same reference numerals. In this embodiment, moreover, the turn and movement are carried out by the registration drive motor 115 for moving the registration rod 103.

The registration drive portion 101, as disposed in the lower portion, of the sheet registration apparatus 100 is mounted on the drive plate 105 which is fixed in the base bottom of the support member 77 uniting the sort bins 76. In the drive plate 105, there is formed the groove-shaped rack guide 106, in which the moving rack 107 is fitted. On this moving rack 107, there is rotatably supported the input gear 110. In the moving rack 107, moreover, there is fixed the thrust bearing 111 which supports the stem 103a of the registration rod 103 turnably. On this stem 103a of the registration rod 103, there is fixed the drive gear 112 which meshes with the input gear 110.

On the drive plate 105, on the other hand, there is mounted in the fixed state a stationary rack 145 which has teeth on its one side for rotating the input gear 110 to turn the registration rod 103. The stationary rack 145 is in parallel with the rack guide 106 or the like at its side edge which has the teeth to mesh with the input gear 110. As a result, this input gear 110 is rotated in meshing engagement with the teeth of the stationary rack 145 while the moving rack 107 is being moved by the guide of the rack guide 106.

Here, the shown stationary rack 145 is partially cut away so as to provide an easy reference to the remaining parts.

The moving rack 107 meshes with the input gear 113 which is rotatably supported on the drive plate 105. The input gear 113 is connected through the intermediate gear 114 to the motor gear 116 which is fixed on the output shaft of the registration drive motor 115.

With the construction thus far described, when the registration drive motor 115 rotates in the direction G of FIG. 32, the driving force of the registration drive motor 115 is transmitted by the input gear 113 to the moving rack 107 to move this rack 107 in the direction A of FIG. 32 along the rack guide 106. When the moving rack 107 moves at this time in the direction A, the input gear 109 accordingly rotates clockwise of FIG. 32 to turn the registration rod 103 in the direction F of FIG. 32 through the drive gear 112.

When the registration drive motor 115 is energized to rotate in the direction H of FIG. 32, on the contrary, the moving rack 107 moves in the direction B of FIG. 32, and the registration rod 103 is turned to the direction E of FIG. 32 and moved into the direction B. On the drive plate 105, on the other hand, there is fixed the registration home position sensor S5 for detecting the home position of the registration rod 103 by detecting the action member 107*a* carried on the moving rack 107. When the registration rod 103 is at the home position, it is located outside (in the direction B of FIG. 8) of the maximum sheet width Hmax of the sheets to be discharged onto the sort bin 76 shown in FIG. 8.

The remaining construction is identical to that of the drive portion of the registration rod 103, as has been described with reference to FIG. 9.

With the construction thus far described, by moving the moving rack 107, which supports the input gear 110 engaging with the stationary tack 245 rotatably, relative to the stationary rack 145, the registration rod 103 can be turned and moved in parallel by using the registration drive motor 115 as the single drive source. As a result, when the registration rod 103 is moved into the direction A to register the sheets in the direction perpendicular to the delivery direction, it can be turned to the direction F to register the sheets in parallel with the delivery direction.

Thus, the cost and size can be reduced by using the single drive source.

Here, the construction shown in FIG. 32 is remarkably advantageous especially in that the registration rod 103 is moved and turned by the single drive source or the registration drive motor 115 to register the sheets in the discharge direction and in the perpendicular direction. Here will be further described the construction for promoting this effect.

In short, the construction of FIG. 32 is made such that the registration rod 103 can be moved into the direction A and turned to the direction F by the single drive source. As a result, the registration rod 103 is moved in parallel in the direction B from the registration position h3 for each size and is turned to the direction E. At this time, it is conceivable that the once registered sheets P are disturbed by the turn of the registration rod 103.

Figure 33:
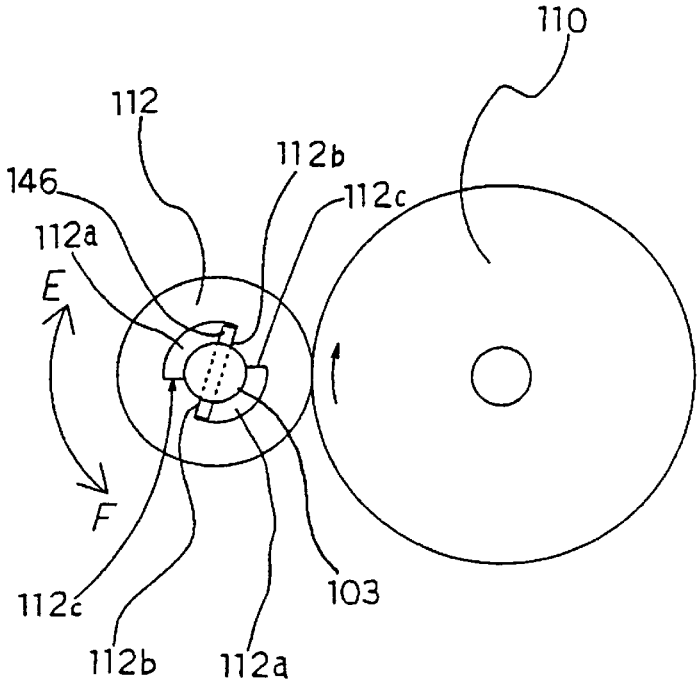
FIG. 33 is a top plan view showing one example of the construction for preventing the disturbance of the sheets by the registration rod 103 in the sheet registration apparatus 100 of FIG. 32.

In order to solve this problem, around that portion, in which the registration rod 103 is fitted, of the drive gear 112, as shown in FIG. 33, there are formed notches 112*a* which are symmetric around the registration rod 103. In these notches 112*a,* there is mounted a stationary pin 146 which is fixed through the registration rod 103, so that no rotation may be transmitted to the registration rod 103 when the pin 146 moves the notches 112*a*.

Thus, when the input gear 110 is rotated in the direction of arrow, the drive gear 112 rotated in the direction F for the registration. At this time, an engagement portion 112*b* of one notch 112*a* of the drive gear 112 comes into engagement with the pin 146 to turn the registration rod 103 in the direction F. When the drive gear 112 is rotated in the direction E during the movement in the direction B from the registration position h3 for each size, moreover, no rotation is transmitted, while the notches 112*a* are passing, to the registration rod 103 so that the registration rod 103 is moved away from the sheets P. When the pin 146 comes into engagement with the engagement portion 112*c* of the notch 112*a* of the drive gear 112, the turn of the registration rod 103 in the direction E is then started.

Thus, when the registration rod 103 leaves the registered sheets P, it is separated at first with no turn from the sheets P so that the registered sheets are not disturbed. Specifically, the registration rod 103 contacting with the sheets P is moved into the direction B by providing those notches 112*a*. When the registration rod 103 leaves the sheets, it is turned to the direction E with a time delay so that the registered sheets are not disturbed.

Fifth Embodiment

This embodiment is intended to prevent the lowermost sheet, when the sheets P on the sort bins 76 are to be registered by the registration rod 103 each time they are discharged, from being damaged by turning in contact at all times with the registration rod 103 for the registration.

This embodiment will be described with reference to FIGS. 34 to 36.

Figure 34:
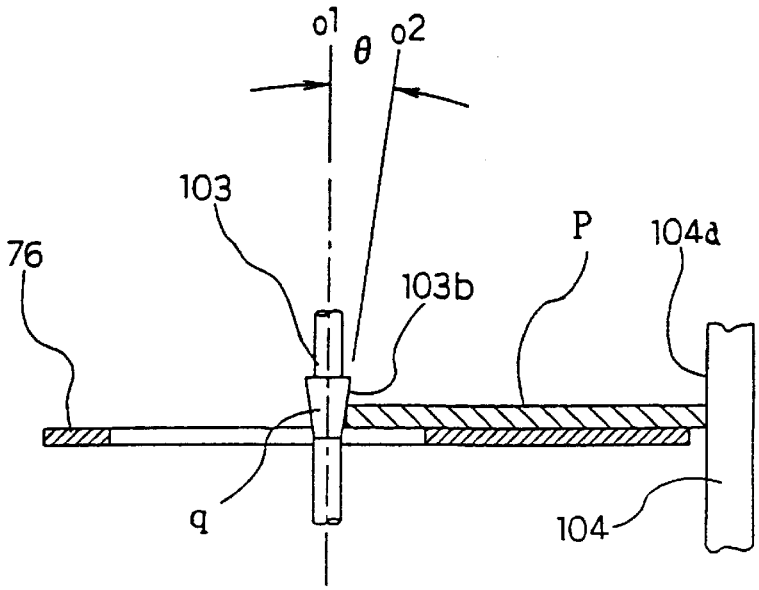
FIG. 34 is a section showing a sheet registered state of a fifth embodiment of the sheet registration apparatus 100 of the invention.
Figure 35:
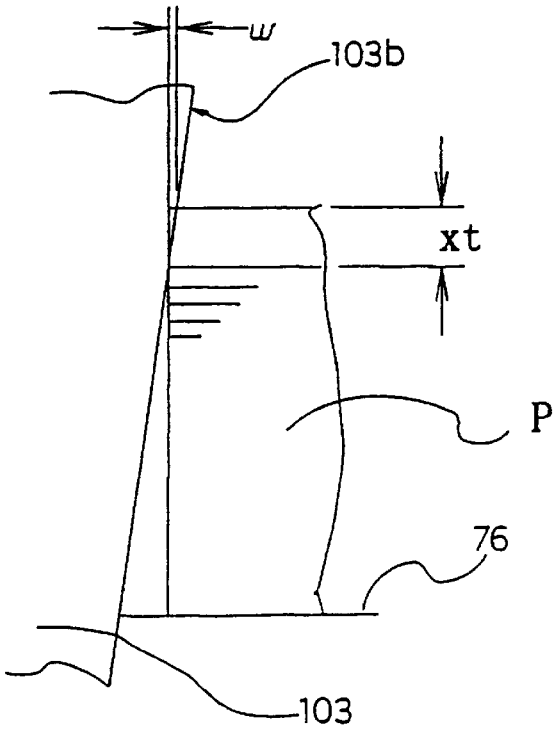
FIG. 35 is an enlarged diagram showing an essential portion for the sheet registration of FIG. 34.

FIG. 34 is a section showing the state in which the sheets P are registered in the registration region by the registration rod 103 acting as the registration member of the invention. FIG. 35 is an enlarged diagram showing an essential portion of the registration rod of FIG. 34. Moreover, FIG. 36 is a flow chart for controlling the registering action of the registration rod of this embodiment.

The registration rod 103 has a registration portion 103*b*, at which the registration rod 103 contacts with the sheets P to be registered, and which is formed into a frusto-conical shape having a diameter increased as the sheets P are discharged on the sort bin 76 in the direction (i.e., upward of FIG. 34) to be registered (or stacked), as shown in FIG. 34. Letter θ appearing in FIG. 34 designates an angle which is made between a straight line o2, on which a plane extending through an axis o1 of rotation of the registration rod 103*a* intersects of the circumference q of the registration portion 130*b* (or the frusto-conical portion), and the axis o1 of rotation.

In order to describe this embodiment, here will be described the control operations for the sheet registration with reference to FIG. 13 and FIGS. 36A and 36B. An especial explanation will be made on the registration operation at the non-staple sort mode, for example.

Figure 36A:
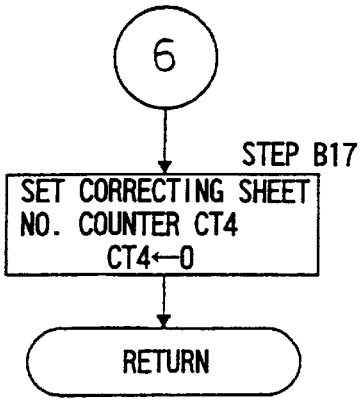
FIGS. 36A and 36B are control flow charts showing the individual procedures of the sheet registration of FIG. 34.
Figure 36B:
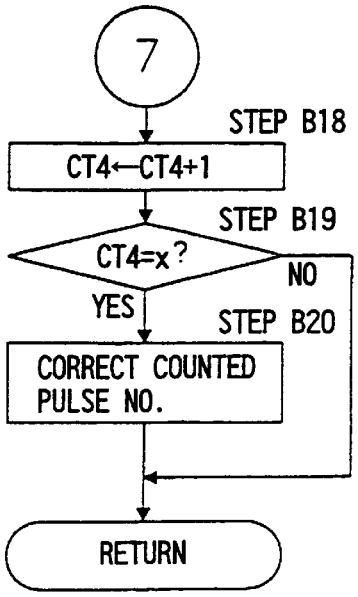

In the flow of FIG. 13, the flow of FIG. 36A is inserted just after STEP B8 (as indicated by ⑥ in FIG. 13), and the flow of FIG. 36B is inserted into the loop (as indicated by ⑦ in FIG. 13) returned to just before STEP B9 in the case the value of the sheet number counter CT1 of STEP B12 is not equal to the copy sheet number "n".

In the routine of FIG. 36A, a correcting sheet number counter CT4 is set to zero (at STEP B17). In the routine of FIG. 36B, the value 1 is added to the correcting sheet number counter CT4 (at STEP B18). After this, it is decided (at STEP B19) whether or not the correcting sheet number counter CT4 is equal to a predetermined sheet number "x". The routine jumps the next Step, in the case of non-equality, but advances to the next Step in the equal case. At this next STEP B20, the counted pulse number, as required for the registration rod 103 to move in the registration at the stack time between the registration position h3 for each size and the stand-by position h1 for each size, is finely corrected by 2 (as shown in FIG. 35) in the moving direction (in the direction A of FIG. 19) of the registration rod 103 when x-sheets of a paper thickness t are stacked.

By this control, the registration portion 103*b* can be brought into abutment against only the uppermost one of the sheets P to be stacked. As shown in FIG. 35, therefore, the registration portion 103*b* of the registration rod 103 comes not into contact with the lower sheets P registered already but into contact with the upper sheets P discharged and stacked, so that it will not damage the sheets P.

In this embodiment, the registration portion 103*b* of the registration rod 103 is moved horizontally but may be controlled to move vertically. In this control, the registration rod 103 may be moved by a predetermined extent each time the predetermined sheet number (x) of sheets P are stacked, so that only the stacked sheets P near the top may come into abutment against the registration rod 103. However, this control requires an additional mechanism for moving the registration portion 103*b* vertically. For this requirement, this embodiment can employ the mechanism which is intrinsically necessary for moving the registration portion 103*b* in the direction A–B. This makes is possible to avoid the complex structure which might otherwise be made by adding the new mechanism.

Here in this embodiment, the registration portion 103*b* is formed into the frusto-conical shape in which its diameter is enlarged in the direction for the sheets P to be stacked. The shape should not be limited to the frusto-cone if its diameter is enlarged in the direction for the sheets to be stacked.

Another Embodiment

In the embodiments thus far described, the numerous sort bins 76-1 to 76-n are provided for sorting the imaged sheets P, as has been described with reference to FIGS. 1 and 2, so that the sheets P may be sorted by moving the sort bins 76 vertically. Thus, the sorting discharge rollers 75 are fixed.

In another construction, the sheets P are sorted by fixing the numerous sort bins 76-1 to 76-n but by moving the sort discharge rollers 75. When the sheets are to be registered always at a constant level by moving the sort bins 76 vertically, this registration can be performed by forming the frustoconical registration portion 103*b* in the registration rod 103 for the sort bins 76, as shown in FIG. 34. However, a dispersion may occur when all the sheets P on the fixed sort bins 76-1 to 76-n are to be registered under the identical conditions.

Figure 37:
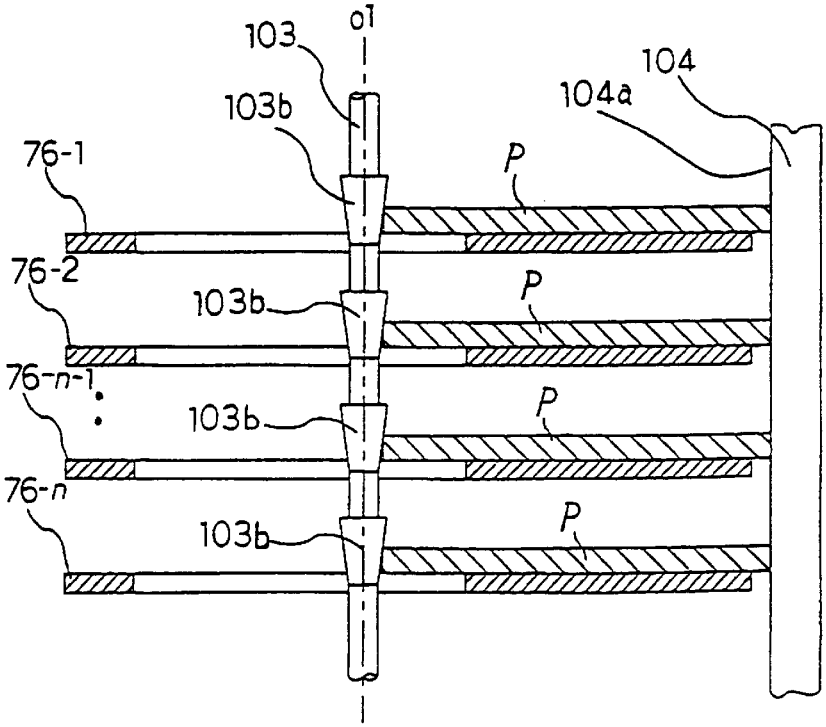
FIG. 37 is a section showing the sheet registered state for explaining another embodiment of the sheet registration apparatus 100 of the invention.
Figure 38:
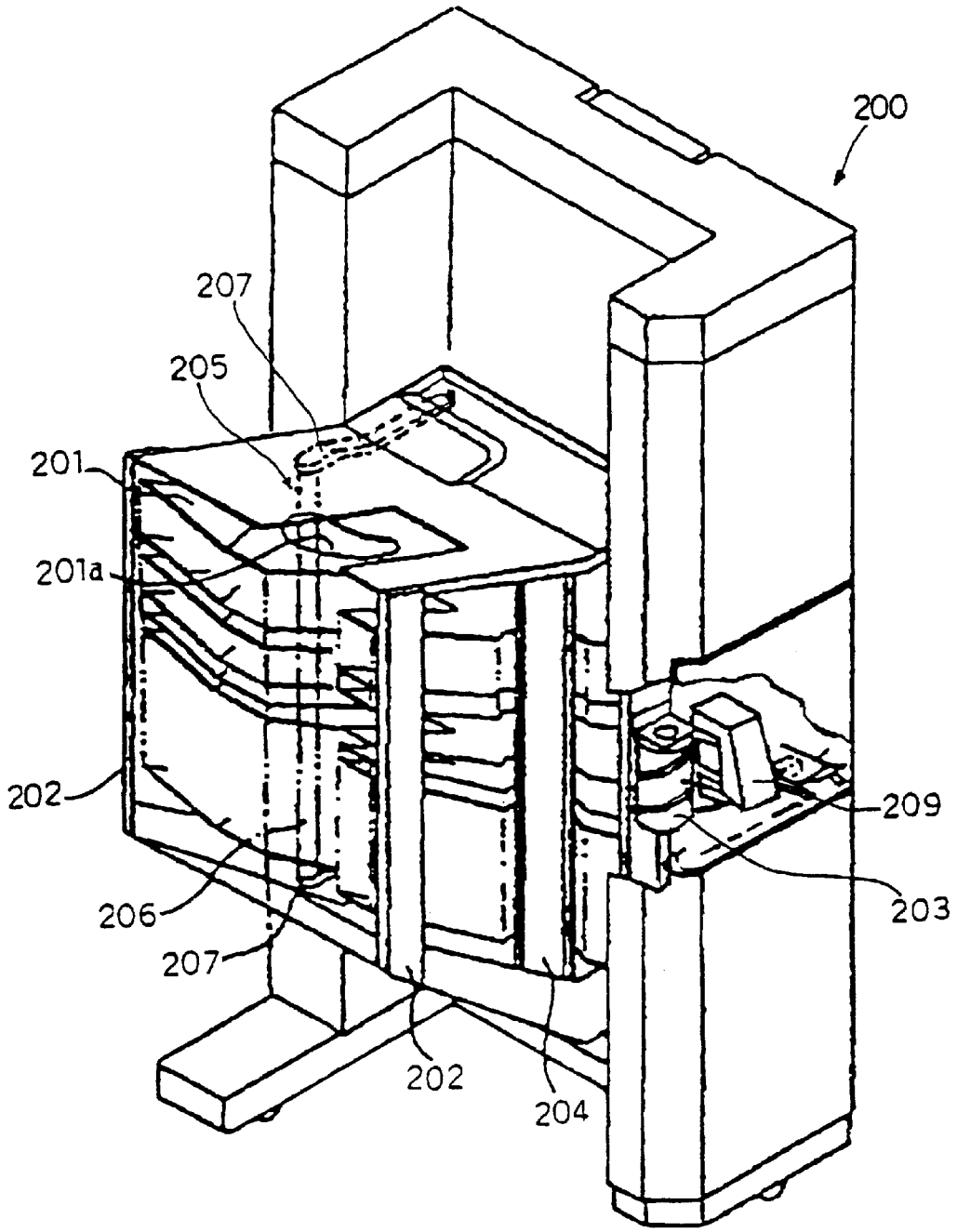
FIG. 38 PRIOR ART
FIG. 38 is a perspective view schematically showing the sorter having the stapling function equipped with the sheet registration apparatus of the prior art.

By constructing the registration rod 103 shown in FIG. 37, therefore, it is possible to eliminate the dispersion in the sheet registered states among the individual sheet bins 76-1 to 76-n.

In FIG. 37, more specifically, the registration reference of the individual sort bins 76-1 to 76-n is provided by the regulation face 104*a* of one regulation plate 104 extending vertically of the individual bins. The registration rod 103 is so arranged the regulation face 104*a* of the regulation plate 104 and the axis o1 of rotation of the registration portion 103*b* of the registration rod 103 may be in parallel with each other. All the registration portions 103*b* of the registration rod 103 for the individual bins are given an identical shape. With this construction, the sheet registration is made in accordance with the registration flow which has been described in the foregoing fifth embodiment.

In the stationary multi-sort bin type sorter of this embodiment, the registration rod 103 is provided with the registration portions 103*b* corresponding to the individual sort bins 76-1 to 76-n, and the distances of the regulation plate 104 or the registration reference position shared among the individual sort bins 76-1 to 76-n from the regulation face 104*a* are equalized. As a result, the position corrections for the controls of the registration need not be changed for the individual sort bins, but the registrations of the sheets P for the individual sort bins can be homogenized. As a result, the positions of the post-treatments are not moved for the individual sort bins merely by moving the post-treatment means such as the staple or punch vertically along the registration reference position.

Here, after the sheets P accommodated in the sort bins 76-1 to 76-n are registered, they are stapled or punched (or perforated). For these operations, the registration rod 103 is moved to the registration position h3 for each size at STEP B14 of FIG. 13 and at STEP D25 of FIG. 15 so that the sheets can be post-treated to the determined normal position with neither becoming loose nor being disturbed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A sheet registration apparatus comprising:

a first regulation member for regulating and registering a first edge of one or more sheets; and a second regulation member for regulating and registering a second edge of the sheets substantially perpendicular to the first edge, the second regulation member being perpendicular to the first regulation member, the sheets being moved to the first and second regulation member so as to be registered, the registration apparatus further comprising:

a single registration member which effects a translational motion for transporting the sheets to the first regulation member so as to regulate and registrate the frst edge of the sheets with the first regulation member, and additionally effects a rotational motion about its own axis for transporting the sheets to the second regulation member in conjunction with the translational motion to regulate and registrate the second edge of the sheets with the second regulation member.

2. The sheet registration apparatus of claim 1, wherein the registration member translates diagonally toward the first and second regulation member so as to transport the sheets to the first regulation member by said translational motion and where the sheets are also transported to the second regulation member by the rotational motion of the registration member as it translates diagonally toward said first and second regulation member.

3. The sheet registration apparatus of claim 2, wherein the registration member continuously rotates for a predetermined time period so as to transport the sheets to the second regulation member while maintaining the sheets in a state of abutment against the first regulation member.

4. The sheet registration apparatus of claim 2, wherein the registration member translates or rotates at such a velocity that either the first edge or the second edge of the sheets may abut the first regulation member or the second regulation member before butting the other regulation member.

5. The sheet registration apparatus of claim 1, wherein the first regulation member also effects a rotational motion about its own axis in a direction whereby the sheets are caused to translate to the second regulation member.

6. The sheet registration apparatus of claim 5 wherein the first regulation member includes at least one elongated cylindrical rod member which is vertically oriented and rotatable about its own axis.

7. The sheet registration apparatus of claim 1 wherein the single registration member comprises an elongated cylindrical rod member.

8. The sheet registration apparatus of claim 7 wherein the rod member is oriented substantially vertically in the apparatus.

9. The sheet registration apparatus of claim 1, wherein the sheet registration apparatus comprises:

first drive means effecting linear translation of the assembly; and second drive means located on the assembly for effecting rotation of the elongated cylindrical rod member about its own central longitudinal axis.

10. The sheet registration apparatus of claim 9 wherein said at least one rod member comprises a plurality of mutually parallel vertically oriented rod members which are rotatable about their respective axes.

11. A sheet registration apparatus comprising:

a first regulation member for regulating and registering a first edge of one or more sheets; and a second regulation member for regulating and registering a second edge of said one or more sheets substantially perpendicular to the first edge, the second regulation member being perpendicular to the first regulation member, the sheets becoming registered by transport thereof to the first and second regulation members, the registration apparatus further comprising:

a registration member which translates toward and away from the first and second regulation member and rotates about its own axis;

an assembly for rotatably supporting and linearly translating the registration member diagonally toward the first and second regulation member; and means for rotating the registration member on the assembly in a direction whereby the sheets are transported to the second regulation member.

12. The sheet registration member of claim 11, the sheet registration apparatus further comprising:

drive means for effecting linear movement of the assembly; and wherein the means for rotating the registration member includes, a rotation transmission mechanism mounted on the assembly and being rotatably connected to the registration member; and a stationary rack type member located adjacent the assembly and mechanically coupled to the transmission mechanism for effecting rotation of the registration member about its own axis in response to translational movement of the assembly for supporting and translating the registration member.

13. The sheet registration apparatus of claim 12, wherein the rotation transmission mechanism includes a play portion for temporarily stopping the rotation of the registration member to make the same unrotative when rotation is transmitted from the rotation transmission mechanism to the registration member.

14. The sheet registration apparatus of claim 1, wherein the registration member includes an abutment face contacting the sheets that is gradually inclined in a direction in which the sheets are stacked.

15. The sheet registration apparatus of claim 11, wherein the registration member includes an abutment face contacting the sheets that is gradually inclined in a direction in which the sheets are stacked.

* * * * *